US007162770B2

(12) United States Patent
Davidshofer

(10) Patent No.: US 7,162,770 B2
(45) Date of Patent: Jan. 16, 2007

(54) DUST SEPARATION SYSTEM

(75) Inventor: Don Davidshofer, Bloomington, IL (US)

(73) Assignee: Electrolux Home Care Products Ltd., Cleveland, OH (US)

( * ) Notice: Subject to any disclaimer, the term of this patent is extended or adjusted under 35 U.S.C. 154(b) by 25 days.

(21) Appl. No.: 10/996,467

(22) Filed: Nov. 26, 2004

(65) Prior Publication Data

US 2005/0132529 A1 Jun. 23, 2005

Related U.S. Application Data

(60) Provisional application No. 60/524,910, filed on Nov. 26, 2003.

(51) Int. Cl.
*A47L 9/165* (2006.01)
*B01D 45/12* (2006.01)

(52) U.S. Cl. ..... 15/353; 55/337; 15/327.1

(58) Field of Classification Search ..... 15/327.1, 15/327.2, 327.6, 327.7, 347, 350–353; 55/337, 55/342, 343, 346, 347, 391
See application file for complete search history.

(56) References Cited

U.S. PATENT DOCUMENTS 2,071,975 A * 2/1937 Holm-Hansen ..... 55/413
4,885,817 A 12/1989 Tanase
4,985,058 A 1/1991 Prinsloo et al.
5,129,125 A 7/1992 Gamou et al.
5,160,356 A 11/1992 Dyson
5,230,722 A 7/1993 Yonkers
5,262,046 A 11/1993 Forgac et al.
5,350,432 A 9/1994 Lee
5,797,162 A * 8/1998 Vystrcil et al. ..... 15/323

(Continued)

FOREIGN PATENT DOCUMENTS

FR 1468142 2/1967

(Continued)

OTHER PUBLICATIONS

Zhang, Wang & Riskowski; "Particle Separation Efficiency of a Uniflow Deduster with Different Types of Dusts;" downloaded from http://www.age.uiuc.edu/bee/Research/Deduster/dedpaper2.html on Jul. 18, 2002; 9 pages.

(Continued)

*Primary Examiner*—Terrence R. Till
(74) *Attorney, Agent, or Firm*—Hunton & Williams

(57) ABSTRACT

A vacuum cleaner having a nozzle, a handle pivotally attached to the nozzle, and a suction motor that has an inlet, and is adapted to generate a working air flow through the nozzle. The vacuum includes a separation system having an outer wall and a closed tube having at least a portion of its length located within the wall, and forming a separation chamber between the wall and the closed tube. The separation chamber has an inlet, in communication with the nozzle, that is adapted to impart a tangential component to the air flow as it flows through the separation chamber. A hollow tube is generally coaxially aligned with the closed tube and has a tube inlet at an end adjacent the closed tube and a tube outlet at an end opposite the closed tube. The tube outlet is in fluid communication with the suction motor inlet.

46 Claims, 27 Drawing Sheets

U.S. PATENT DOCUMENTS

| | | | | |
|---|---|---|---|---|
| 5,950,274 | A | 9/1999 | Kilström | |
| 6,083,292 | A | 7/2000 | Fumagalli | |
| 6,131,239 | A * | 10/2000 | White | 15/352 |
| 6,228,151 | B1 | 5/2001 | Conrad et al. | |
| 6,312,594 | B1 | 11/2001 | Conrad et al. | |
| 6,332,239 | B1 | 12/2001 | Dubos et al. | |
| 6,334,234 | B1 | 1/2002 | Conrad et al. | |
| 6,344,064 | B1 | 2/2002 | Conrad | |
| 6,350,292 | B1 | 2/2002 | Lee et al. | |
| 6,391,095 | B1 | 5/2002 | Conrad et al. | |
| 6,425,931 | B1 | 7/2002 | Croggon | |
| 6,428,589 | B1 | 8/2002 | Bair et al. | |
| 6,502,278 | B1 | 1/2003 | Oh et al. | |
| 6,546,593 | B1 | 4/2003 | Oh et al. | |
| 6,558,453 | B1 | 5/2003 | Sepke et al. | |
| 6,562,093 | B1 | 5/2003 | Oh | |
| 6,565,321 | B1 | 5/2003 | Illingworth et al. | |
| 6,578,230 | B1 | 6/2003 | Park et al. | |
| 6,607,572 | B1 | 8/2003 | Gammack et al. | |
| 6,673,133 | B1 | 1/2004 | Sechrist et al. | |
| 6,679,930 | B1 | 1/2004 | An et al. | |
| 6,732,406 | B1 | 5/2004 | Oh | |
| 6,746,500 | B1 | 6/2004 | Park | |
| 6,829,804 | B1 | 12/2004 | Sepke | |
| 6,833,015 | B1 | 12/2004 | Oh et al. | |
| 6,840,972 | B1 | 1/2005 | Kim | |
| 2002/0046438 | A1 * | 4/2002 | Oh | 15/353 |
| 2003/0159238 | A1 | 8/2003 | Oh | |
| 2003/0208879 | A1 | 11/2003 | Oh et al. | |
| 2003/0213091 | A1 | 11/2003 | Oh et al. | |
| 2004/0060146 | A1 | 4/2004 | Coates et al. | |
| 2004/0177471 | A1 | 9/2004 | Jung et al. | |
| 2004/0182053 | A1 | 9/2004 | Conrad et al. | |
| 2005/0229559 | A1 | 10/2005 | Oh et al. | |

FOREIGN PATENT DOCUMENTS

| | | |
|---|---|---|
| JP | 2001-346733 | * 12/2001 |
| WO | WO 99/59458 | 11/1999 |
| WO | WO 00/49932 | 8/2000 |

OTHER PUBLICATIONS

Zhang, Wang & Riskowski; "Particle Separation Efficiency of a Uniflow Deduster with Different Types of Dusts;" downloaded from http://www.age.uiuc.edu/bee/RESEARCH/Deduster/dedpaper2.html on Aug. 17, 2005; 9 pages (color printout).

Unknown Author: "Non-Contact Uniflow Aero-Deduster;" downloaded from http://www.age.uiuc.edu/bee/Research/Deduster/deduster.html on Jul. 18, 2002; 1 page.

Peng, Boot, Udding, Hoffmann, Dries, Ekker & Kater; "Determining the best modelling assumptions for cyclones and swirl tubes by CFD and LDA;" Mar. 2001; 3 pages; Published by International Congress for Particle Technology; Nuremburg, Germany.

"Chapter 6: Centrifugal Separators" Industrial Gas Cleaning Second Edition, by W. Strauss, Pergamon Press, 1975, pp. 216-276.

Entstaubungstechnik, by Dr. Ing. Wilhelm Batel, 1972.

* cited by examiner

DUST SEPARATION SYSTEM

CROSS-REFERENCE TO RELATED APPLICATIONS

This application claims priority to U.S. Provisional Application No. 60/524,910, filed Nov. 26, 2003, which is incorporated herein by reference in its entirety.

FIELD OF THE INVENTION

This invention relates to a dust separation system and particularly to dust separation systems for use in vacuum cleaners.

BACKGROUND OF THE INVENTION

In conventional vacuum cleaners (vacuums), dirt laden air is ducted into the vacuum and deposited into a receptacle supported on or within the vacuum housing. Although many previous vacuums have used a flexible bag as the dirt receptacle, the cost and inconvenience of replacing such bags has led to an increased preference for bagless vacuums. Bagless vacuums separate dirt by cyclonic action and/or duct the stream of dirt-laden air through a reusable filter that filters the dirt particles from the air stream before exhausting the filtered air stream back into the atmosphere. Various different types of filter have been used in bagless vacuums, such as HEPA (High Efficiency Particulate Air) filters and rigid porous plastic materials. In many bagless vacuums, the dirt and dust are stopped by the filter and fall into a removable receptacle for later disposal, but in some cases the filter itself may be shaped to form the dirt receptacle or a portion of the dirt receptacle, much as vacuum bags do. When the bagless vacuum's filter becomes clogged, it can be cleaned by shaking dirt and dust out if it or by using water or detergent to flush the dirt out.

Although bagless vacuums often provide suitable initial vacuuming performance, their filters tend to become clogged during use as debris accumulates on the filter surface, which results in a reduction in the pressure drop (and thus the vacuuming power) at the surface being vacuumed. Although cleaning the filter between uses prolongs the filter life, over time, debris becomes permanently embedded in the filter, despite efforts to clean them. Such clogging leads to reduced vacuuming power, and reduced user satisfaction. As such, it eventually becomes necessary to replace the filter to return the vacuum to suitable performance. In many cases, replacement filters can be relatively costly, or may no longer be available. Furthermore, bagless vacuum filters can sometimes be rapidly clogged by large volumes of large particles that impinge upon and block the filter, and require the user to immediately stop vacuuming to remove the particles from the filter.

Various cyclonic separators have been introduced to help reduce reliance on filters in bagless vacuums. Such cyclonic devices typically introduce the air into a collection chamber in a tangential manner or otherwise induce a cyclonic rotation to the air, and remove the air through an outlet duct located in the axial center of the chamber. Examples of typical cyclonic vacuums are shown in U.S. Pat. Nos. 5,267,371, 6,532,621, 6,536,072, 6,578,230, 6,599,340, 6,625,845, and 6,757,933, all of which are incorporated herein by reference. While such cyclonic vacuums are useful, it has proved difficult to provide a consumer-level vacuum that efficiently and consistently separates particles, dust and other debris from the working air flow without using filters or vacuum bags to physically block the passage of the debris, or resorting to a highly complex and often expensive arrangement of cyclone separators. It has also been difficult to provide a vacuum that efficiently and consistently separates larger particles from dust and other small particles to inhibit the impingement of large particles on the vacuum filter. It has further been difficult to provide a cyclonic separation system for vacuum cleaners that is compact and relatively flexible in the manner in which it can be incorporated into the vacuum cleaner.

SUMMARY OF THE INVENTION

The present invention provides a separation system for vacuum cleaners. In a first preferred embodiment, the invention comprises an upright vacuum cleaner having a nozzle that is adapted to be traversed on a surface to be cleaned, and has an internal passage defined by a nozzle inlet positioned to be substantially adjacent the surface to be cleaned and a nozzle outlet remote from the nozzle inlet. A handle is pivotally attached to the nozzle, and a suction motor is provided in the nozzle or the handle. The suction motor has a suction motor inlet, and is adapted to generate a working air flow through the nozzle and into the suction motor inlet. The device further includes a separation system comprising: an outer wall, a closed tube having at least a portion of its length located within the outer wall and forming a separation chamber between the outer wall and the closed tube, a separation chamber inlet in fluid communication with the nozzle outlet and adapted to impart a tangential component to the working air flow as it flows through the separation chamber, and a hollow tube that is generally coaxially aligned with the closed tube and has a tube inlet at an end adjacent the closed tube and a tube outlet at an end opposite the closed tube. The tube outlet is in fluid communication with the suction motor inlet. The device of this embodiment also includes a collection chamber for receiving dirt separated from the working air flow.

In a second preferred embodiment, the invention provides a vacuum cleaner having a nozzle that is adapted to be traversed on a surface to be cleaned. The nozzle has an internal passage defined by a nozzle inlet positioned to be substantially adjacent the surface to be cleaned and a nozzle outlet remote from the nozzle inlet. The vacuum cleaner has a main vacuum housing that is attached to the nozzle by way of a flexible hose, and a suction motor mounted in the main vacuum housing. The suction motor has a suction motor inlet, and is adapted to generate a working air flow through the nozzle and into the suction motor inlet. This embodiment also provides a separation system comprising: an outer wall, a closed tube having at least a portion of its length located within the outer wall and forming a separation chamber between the outer wall and the closed tube, a separation chamber inlet in fluid communication with the nozzle outlet and adapted to impart a tangential component to the working air flow as it flows through the separation chamber, and a hollow tube, generally coaxially aligned with the closed tube, having a tube inlet at an end adjacent the closed tube and a tube outlet at an end opposite the closed tube. The tube outlet is in fluid communication with the suction motor inlet. This embodiment also provides a collection chamber for receiving dirt separated from the working air flow.

In another embodiment, the invention again provides a vacuum cleaner having a nozzle adapted to be traversed on a surface to be cleaned and having an internal passage defined by a nozzle inlet positioned to be substantially adjacent the surface to be cleaned and a nozzle outlet remote from the nozzle inlet. This embodiment has a suction motor that is mounted to the vacuum cleaner and adapted to generate a working air flow through the nozzle and into a suction motor inlet. The separation system of this embodiment is located, in a fluid flow sense, between the nozzle outlet and the suction motor inlet, and includes a first separator and a second separator. The first separator and the second separator are both adapted to remove dirt from the working air flow, and the device includes at least one collection chamber adapted to receive dirt separated from the working air flow. In this embodiment, the first separator comprises at least one co-linear tube separator comprising: an outer wall, a closed tube having at least a portion of its length located within the outer wall and forming a separation chamber between the outer wall and the closed tube, a separation chamber inlet in fluid communication with the nozzle outlet and adapted to impart a tangential component to the working air flow as it flows through the separation chamber, and a hollow tube, generally coaxially aligned with the closed tube, having a tube inlet at an end adjacent the closed tube and a tube outlet at an end opposite the closed tube, the tube outlet being in fluid communication with the suction motor inlet.

DETAILED DESCRIPTION OF PREFERRED EMBODIMENTS

Figure 1:
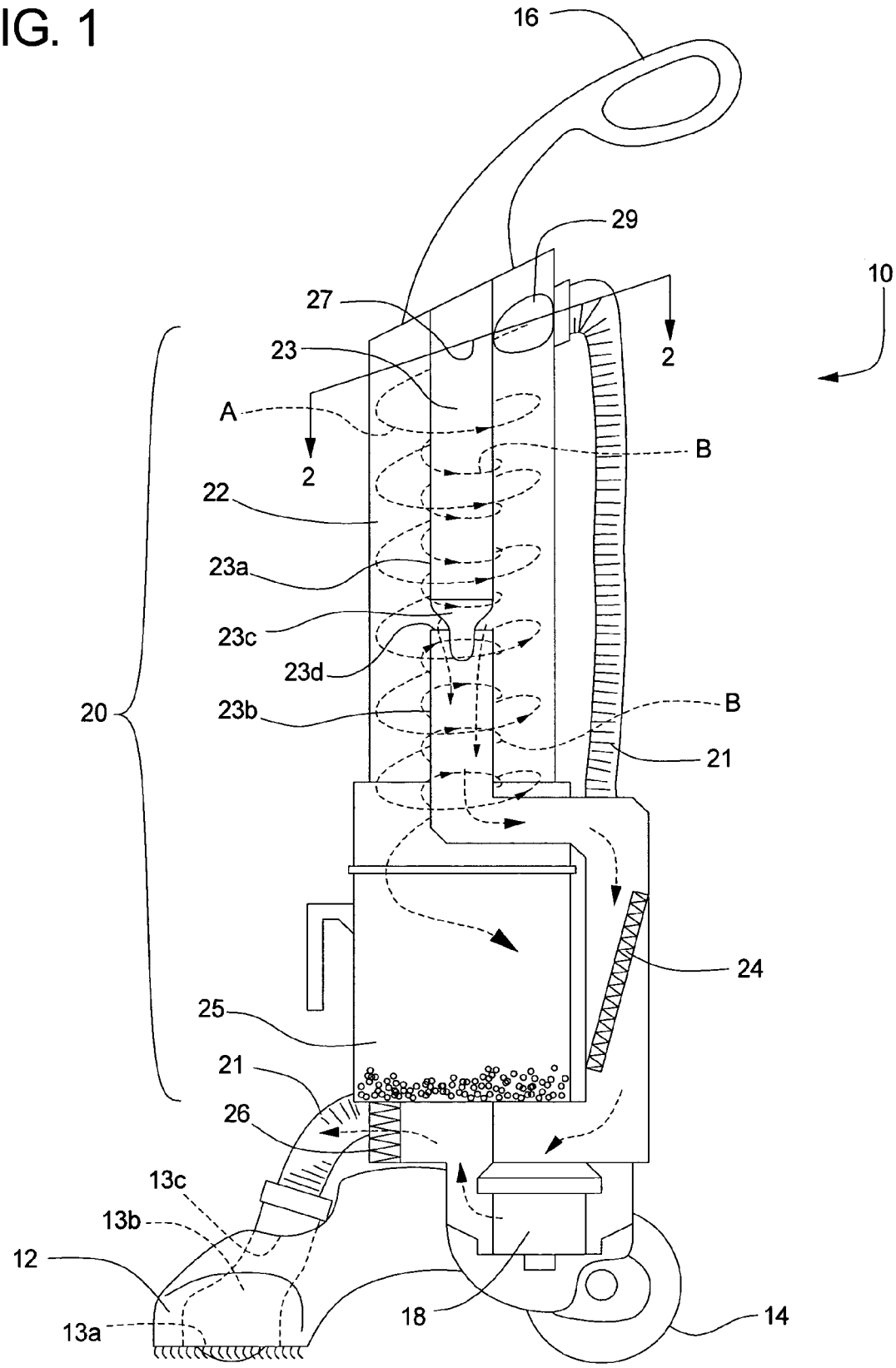
FIG. 1 is a partial cross-sectional schematic of an upright vacuum cleaner incorporating the dust separation system according to a first preferred embodiment.

One of the objects of the invention is to provide a vacuum cleaner employing a device to create a spiraling column of airflow to facilitate the separation of particles, dust and other debris from the airflow in which they are entrained. To this end, one vacuum cleaner according the preferred embodiments includes a generally cylindrical separating chamber within which resides a central obstruction such as a plastic or PVC tube. A chamber entry port is positioned in the vicinity of one end of the obstruction and oriented to direct the incoming air and entrained debris into the chamber at an angle. A return air inlet is positioned in the obstruction itself, and is placed in fluid communication with a suction source to provide the vacuum necessary to operate the device. As such, the obstruction is formed by a closed tube and a hollow tube. A removable debris collection chamber is positioned below the separating chamber to collect dirt, dust and other debris. Baffles or other devices may be placed between the separation chamber and the collection chamber to prevent debris collected therein from reentering the separation chamber. The system also optionally includes pre-motor and/or post-motor filter screens which, along with the separation function achieved by the spiral flow path, serves as a further filtration device.

In operation, a spiraling columnar airflow is created in the separation chamber as the air and entrained debris are injected into the separation chamber at an angle through the chamber entry port. The airflow circulates around the obstruction, and tends to conform to the surface of the obstruction proximal to the return air inlet as it passes therethrough. The centripetal force associated with the larger particles causes the larger particles of debris to rotate in a spiral path having a radius larger than that of the smaller particles. Consequently, the larger particles are separated from the smaller particles as they flow along the separation chamber. As the airflow's spiral path tightens around the obstruction towards the return air inlet, the airflow accelerates and causes even the smaller particles and dust to escape the airflow by centripetal force. The debris removed from the airflow then falls into the collection chamber for later removal.

A first embodiment of the invention is now described in detail with reference to FIG. 1. In this embodiment, the device comprises a vacuum cleaner 10 having a nozzle 12, wheels 14, handle 16, suction motor 18 and a dust separation system 20. The nozzle is adapted to be traversed on a surface to be cleaned, and includes an inlet 13*a*, and internal passage 13*b*, and an outlet 13*c*. The suction motor 18 may be any device that generates a working air flow, such as an electric motor that drives an impeller or fan. The dust separation system 20 includes a rigid or flexible hose 21 or other conduit for transferring debris sucked by nozzle 12 into a separation chamber 22. The hose 21 is fluidly connected to the nozzle outlet 13*c*. It will be appreciated that the hose 21 may be replaced or used in conjunction with one or more rigid passages that are integrally formed with other parts of the device, such as the wall of the separation chamber described below or the handle 16 of the vacuum. Hose 21 may provide a suction path to nozzle 12, and may also be detachable from nozzle 12 to be used as an accessory tool hose. Suction motor 18 can be any type of vacuum-producing device. Other features may also be added to the vacuum cleaner 10, as known in the art.

The separation chamber 22 comprises a generally cylindrical chamber having a central obstruction, which is preferably a cylindrical tube 23 located approximately along the centerline of the separation chamber 22. Tube 23 has a closed upper tube portion 23*a* and a hollow lower tube portion 23*b*, which are arranged approximately co-linearly. This type of separator is referred to herein as a co-linear tube separator. A vortex controller 23*c* is positioned at the end of the upper tube 23*a*, and extends towards or into a corresponding opening 23*d* located at the top of the lower tube 23*b*. The gap between the vortex controller 23*c* and the opening 236 provides a return air inlet to the suction motor 18, into which air from the separating chamber enters and may be directed (as indicated by the arrows) through an optional pre-motor filter 24, which may be any type of filter, but is preferably a HEPA filter.

A collection chamber 25, such as a dust cup or bag, is provided beneath the separating chamber 22. The collection chamber 25 is preferably removable from the vacuum cleaner 10 so that it can be easily emptied and replaced. It is also preferable to make all or a portion of the collection chamber 25 out of a clear material so that its contents can be monitored during use. While this configuration is preferred for this embodiment, the well-known manufacturing flexibility provided by plastic molding techniques (and other manufacturing techniques), allows virtually limitless variations on this configuration. For example, in another embodiment, the collection chamber 25 may actually be formed integrally as part of wall that forms the cylindrical separating chamber 22. In this case, the upper tube portion 23*a* may be fitted to or formed as part of a lid that seals the top of the chamber 22, and removable therewith, and the lower tube portion 23*b* may be molded as part of the wall that forms the combined separation chamber 22 and collection chamber 25. Alternatively, the lower tube portion 23*b* may be separately formed and removable from the combined separation/collection chamber. Various factors may drive such modifications, such as improving the ease of manufacture, assembly, maintenance, and so on, and many other variations will be apparent to persons of ordinary skill in the art without undue experimentation.

In use, air and entrained debris is sucked into nozzle 12, directed through conduit hose 21, and injected into the dust separation system 20. Hose 21 enters through a chamber entry port 29 that enters the separation chamber 22 generally tangentially relative to the chamber's axis (as shown in FIG. 2), and may also be oriented at an angle a to the separation chamber 22 relative to the chamber's axis (as shown in more detail in FIG. 3). As such, when the dust and debris is introduced in the separation chamber 22 (at the top thereof in the embodiment depicted in FIG. 1), the suction forces drawing the dust and debris into the separating chamber 22 cause the dust and debris to follow a columnar spiral path around tube 23. In this columnar spiral airflow, the relatively large and heavy particles of debris tend to follow a spiral flow path having a larger radius than the smaller particles of debris due to their greater mass and associated centripetal force. This phenomenon provides a separation effect that tends to draw the larger particles away from the smaller particles to form a primary flow, shown by arrow A. The smaller, lighter particles tend to remain entrained in the airflow, and more closely flow in the a spiral air path along the outer circumference of the upper tube 23*a*, as shown by arrow B. However, as the airflow's spiral path tightens around the tube 23 towards the return air inlet, the airflow can accelerate to such a degree that centripetal force removes even the smaller particles and dust escape from the airflow.

Figure 2:
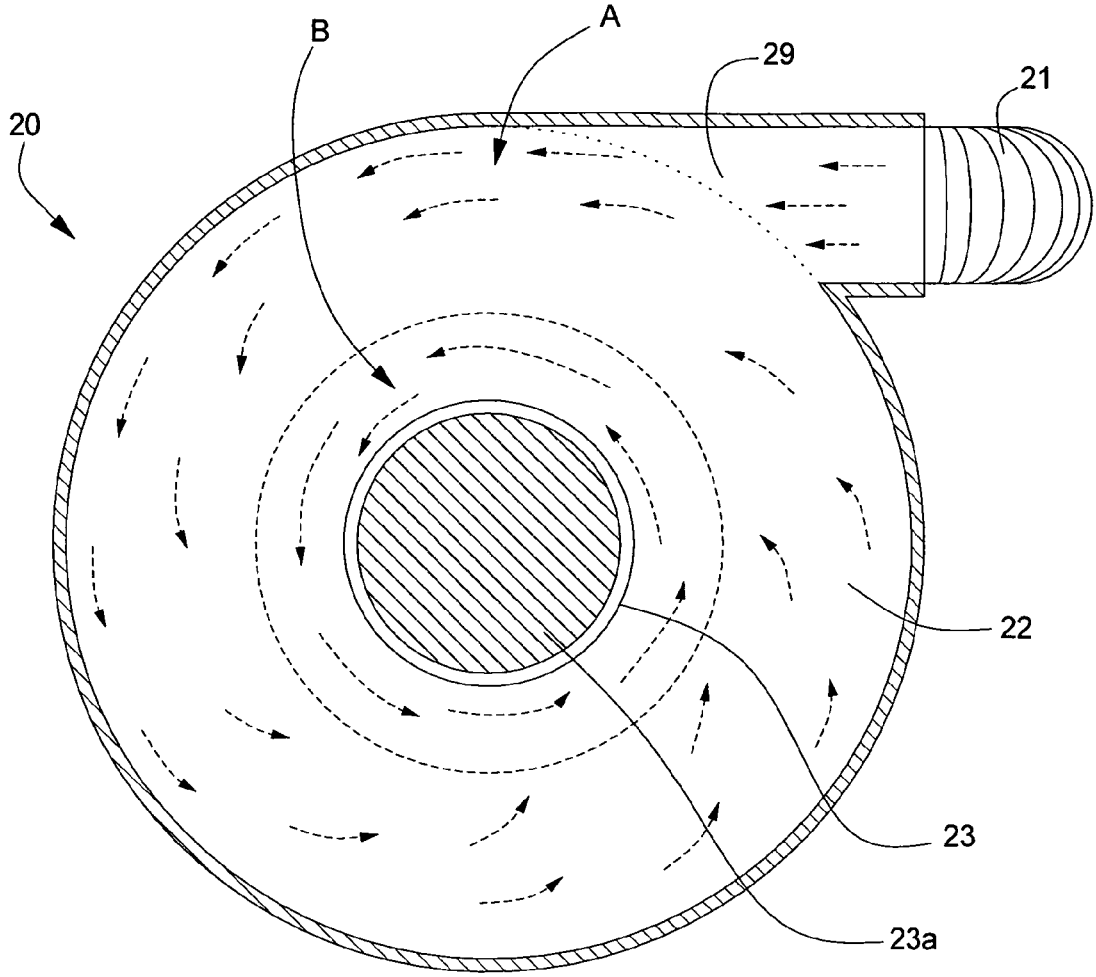
FIG. 2 is a cross section as seen along line 2—2 in FIG. 1 illustrating the primary and secondary airflows within the separation chamber.

FIG. 1 also illustrates the reverse-flow phenomenon that occurs within the airstream at certain locations of certain embodiments of the invention. As the air travels Between the inlet 29 and the entrance 23*d* to the vortex controller, both the primary (outer) flow A and the secondary (inner) flow B move towards the outlet 23*d*. Once the air passes the outlet 23*d*, the primary flow A continues in the same direction (now away from the outlet 23*d*), but the secondary flow B reverses, and still moves towards the outlet 23*d*.

FIG. 2 is a schematic depiction, viewed from above, of the primary and secondary pre-separation phenomenon which occurs in the separation chamber 22. The larger debris tend to follow the airflow path depicted by arrow A, whereas the smaller debris tend to follow a flow path depicted by arrow B, which corresponds more closely to the outer circumference of tube 23. As the air tightens around the cylindrical tube 23, its velocity increases, and so the velocity in the primary flow A is generally lower than the velocity in region B. Similarly, the absolute pressure is generally higher in flow A, than in flow B (that is, region B experiences a greater degree of vacuum). While FIG. 2 shows these two flow regions as being distinct from one another for ease of illustration, it will be appreciated that the change in velocity and pressure will actually be stratified into many layers, or may constitute a gradual change in velocity and pressure. As such, the separation phenomenon described herein may actually constitute many layers of flow or blended flow regions.

Figure 3:
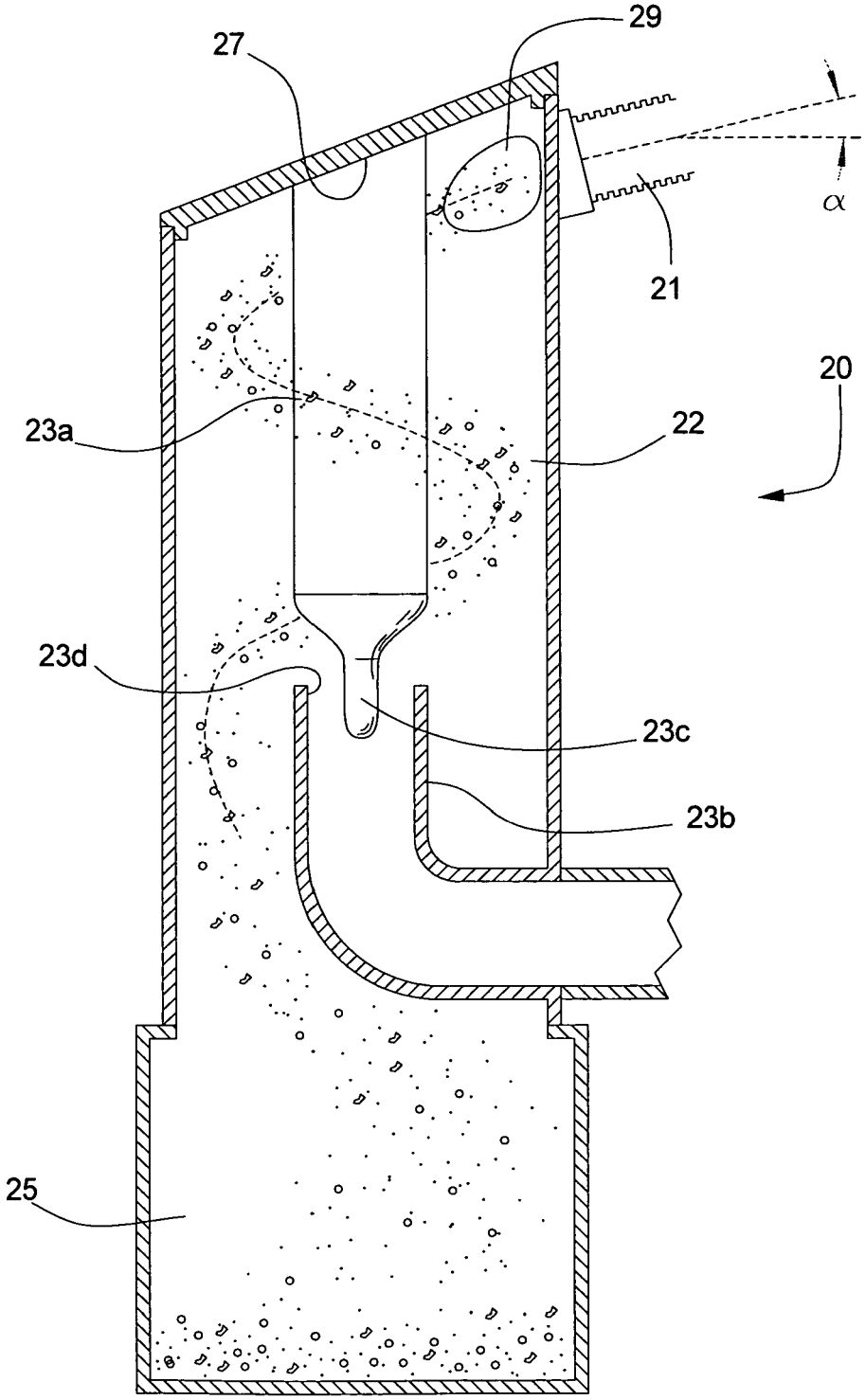
FIG. 3 is a partial cross-sectional schematic of the airflow within the separation chamber in one embodiment of the invention.

Referring now to FIG. 3, in this embodiment of a columnar spiral airflow, the relatively large and heavy particles of debris tend to follow a spiral flow path having a larger radius than the smaller particles of debris due to their greater mass and associated centripetal force. This phenomenon provides a separation effect that tends to draw the larger particles away from the smaller particles, as described before. The smaller, lighter particles tend to remain entrained in the airflow, and more closely flow in the a spiral air path along the outer circumference of the upper tube 23*a*. However, as the airflow's spiral path tightens around the tube 23 towards the return air inlet, the airflow accelerates and causes even the smaller particles and dust to escape the airflow by centripetal force. The debris removed from the airflow falls into the collection chamber 25 for later removal. In this embodiment, it may not be necessary to provide either a pre-motor filter 24 or a post-motor filter 26.

The ability to effectively separate debris without filters provides numerous benefits to manufacturers and consumers. For example, the manufacturer need not incur the extra cost of engineering and manufacture associated with filtration requirements, and the consumer need not replace filters as normally required. Even if a pre- or post-motor filter is used in this embodiment, such filters may benefit from less rigorous use and less frequent maintenance. A pre-motor filter 24 may still be desirable under these circumstances to prevent damage to the suction motor 18 from errant dirt particles or damage caused by particles escaping from an overfilled collection chamber 25. A post-motor filter may be desirable to filter pollutants emitted by the motor itself, such as carbon dust from the motor brushes.

Figure 4:
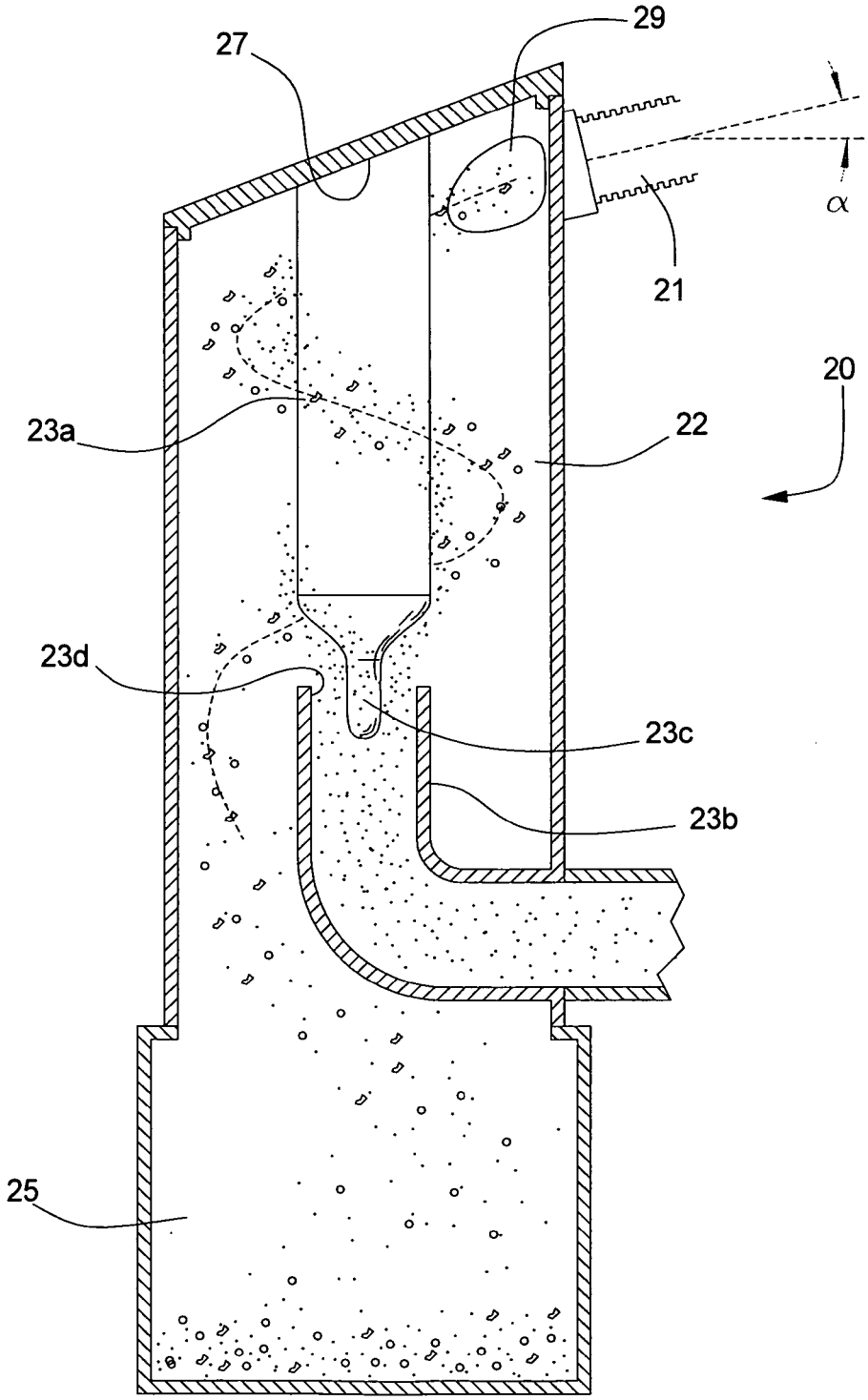
FIG. 4 is a partial cross-sectional schematic of the airflow within the separation chamber in another embodiment of the invention.

Referring now to FIG. 4, in another embodiment of the invention, some or all of the smaller and lighter particles of dirt and dust may remain in the airflow even after it enters the return air inlet between the vortex controller 23*c* and the opening 23*d*. In this embodiment, the larger particles generally fall into the collection chamber 25, while the smaller particles enter opening 23*d*. Thereafter, the air is conveyed to the suction motor 18, and the smaller particles entrained therein may be removed by a pre-motor filter 24 and/or a post-motor filter 26. The smaller particles may also be conveyed to a downstream vortex separator or conventional vacuum bag for further separation.

The vortex controller 23*c* and opening 23*d* are configured to optimize the creation in the separation chamber 22 of a spiral column of air that rotates around tube 23 and throws particles outwardly for deposit in the collection chamber 25. A number of variables can be modified to adjust the performance of the device, such as: the relative sizes of the separation chamber 22 and the tube 23, the length of the upper tube portion 23*a*, the distance from the entry port 29 to the vortex controller 23*c*, the shape of the vortex controller 23*c*, the size of the gap between the vortex controller 23*c* and the opening 23*d*, and the shape of the walls of the lower tube portion 23*b* (particularly around the opening 23*d* and the vortex controller 23*c*). Other variables may become apparent with practice of the invention, and these and other variables may be used to optimize the performance of the device.

The design of the chamber entry port 29 may also have an impact on the debris-separating performance of the vacuum cleaner 10. As shown in FIG. 3, the air is induced into the separating chamber 22 at an angle ($\propto$). Angle $\propto$ is preferably between about 0 and 90 degrees, and more preferably between about 7.5 and 75 degrees, and most preferably between about 10 degrees and 60 degrees. Alternatively, it is within the scope of the preferred embodiments to introduce the air into separation chamber 22 at an angle $\propto$ less than 0 degrees, i.e., so that the air entrained debris is injected upwardly into the separating chamber 22. Furthermore, the upper surface 27 of the separation chamber 22 may also be shaped to help initiate or maintain a desirable spiral airflow in the separation chamber 22. For example, the upper surface 27 may have a conical, hyperbolic, or other contoured or tapered shape.

Variations to the shown entry port 29 design will be apparent to those of ordinary skill in the art. For example, the entry port 29 may be formed in either the walls of the separation chamber 22, or in a lid that is placed over the separation chamber 22. The entry port may also enter the separation chamber 22 from the top, and be curved to impart a tangential flow to the entering air and debris. The entry port 29 may also be perpendicular to the inner wall of the chamber 22, and a wall may be provided to redirect the entering air and debris in a tangential (or at least partially tangential) manner. These or any other construction that causes the entry port 29 to impart a tangential flow to the entering air and debris would be suitable for use with the present invention.

Figure 5:
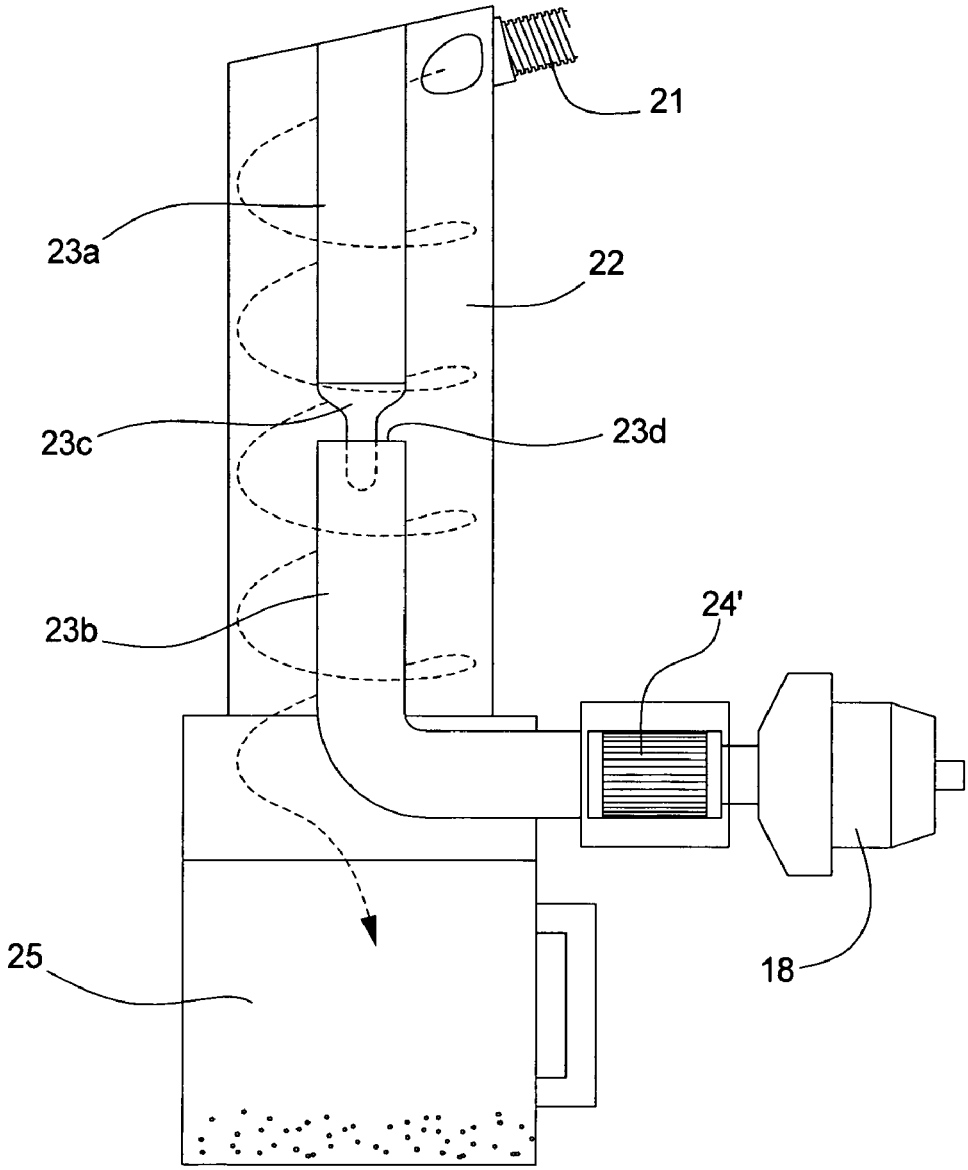
FIG. 5 is a partial cross-sectional schematic of a portion of an upright vacuum cleaner incorporating the dust separation system according to another preferred embodiment.

FIG. 5 illustrates a further preferred embodiment of the invention wherein the panel-type pre-motor filter 24 is replaced by a cylindrical filter screen 24'. The post-motor filter 26 (FIG. 1) also may be replaced by a cylindrical filter or other type of filter. Otherwise, the principles of operation of the dust separation system are the same as in the previous embodiments.

Figure 6:
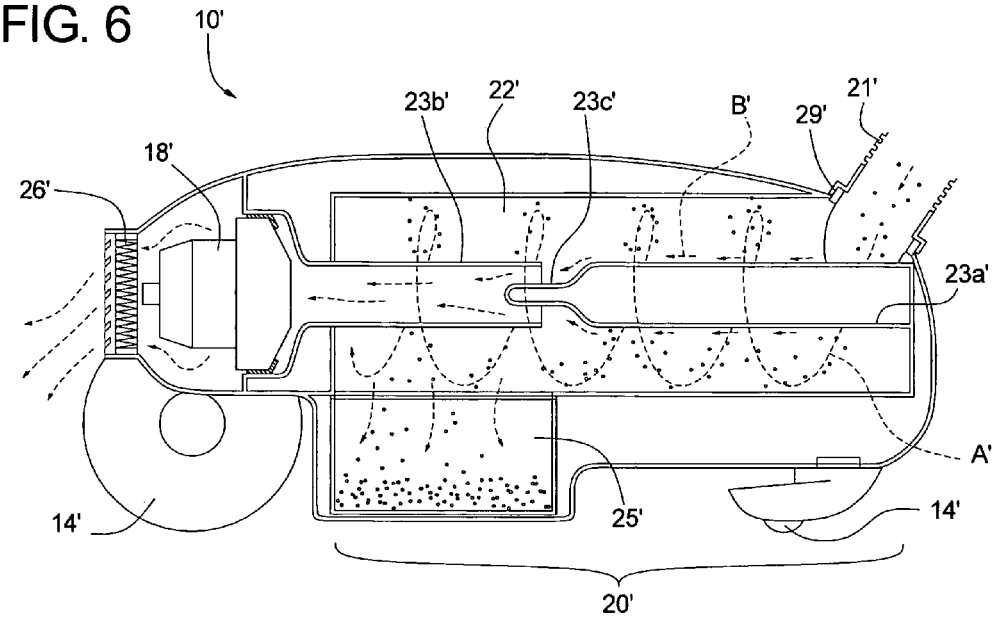
FIG. 6 is a partial cross-sectional schematic of a canister vacuum cleaner incorporating the dust separation system according a further preferred embodiment.

FIG. 6 illustrates another preferred embodiment of the dust separation system in which the system is incorporated into a canister vacuum cleaner 10'. For ease of reference, similar reference numerals have been employed to designate similar elements. The canister vacuum cleaner 10' includes a nozzle (not shown) that is adapted to be traversed across a surface being cleaned and having an inlet adjacent the surface and an internal passage that exits the nozzle at a nozzle exit (see FIG. 1). The nozzle exit is attached at the end of hose or conduit 21', which in turn leads to the dust separation system 20'. The dust separation system 20' includes, like the previous embodiments, a separation chamber 22', within which is contained a central cylindrical obstruction 23'. The principles of operation of the this embodiment are substantially the same as those of the previous embodiments. As can be seen in FIG. 6, the larger particles tend to follow the spiral path indicated by A', whereas the smaller particles tend to follow a path indicated by arrows B'. It should be noted that, while path B' is shown for convenience of illustration as relatively straight arrows, in practice it has been found to exhibit a cyclonic movement about the obstruction 23, much like path A'. The larger particles tend to fall into debris collection chamber 25', and the smaller particles flow through the interior of the obstruction 23*b*', whereupon they are directed through suction motor 18' and then trapped in a post-motor filter 26'. Alternatively, the smaller particles may also be ejected from the airflow and collected in collection chamber 25', as shown in FIG. 3.

Figure 7:
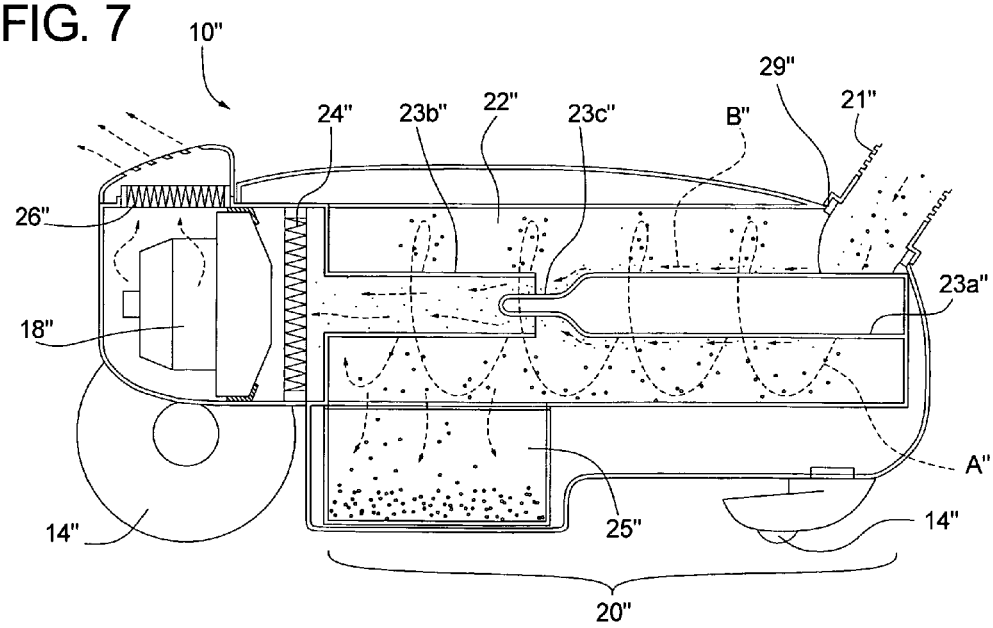
FIG. 7 is a partial cross-sectional schematic of a canister vacuum cleaner incorporating the dust separation system according to a further preferred embodiment.

FIG. 7 depicts yet another preferred embodiment of the dust separation system which in principle and operation is similar to the embodiment of FIG. 6 with the exception that it also has a pre-motor filter screen 24" to collect and remove finer particles of dust and debris from the suction air prior to flowing into the suction motor 18" . As with other filters described herein, the pre-motor filter screen 24" may comprise any kind of filter, such as foam, pleated, mesh screen, perforated plate, and so on, and may pass the HEPA certification requirements. Furthermore, a guard may be placed between the filter screen 24" and the suction motor 18" to prevent the filter screen 24" (or parts thereof) from being ingested by the suction motor 18" in the event the filter screen 24" suffers from a catastrophic failure.

Figure 8:
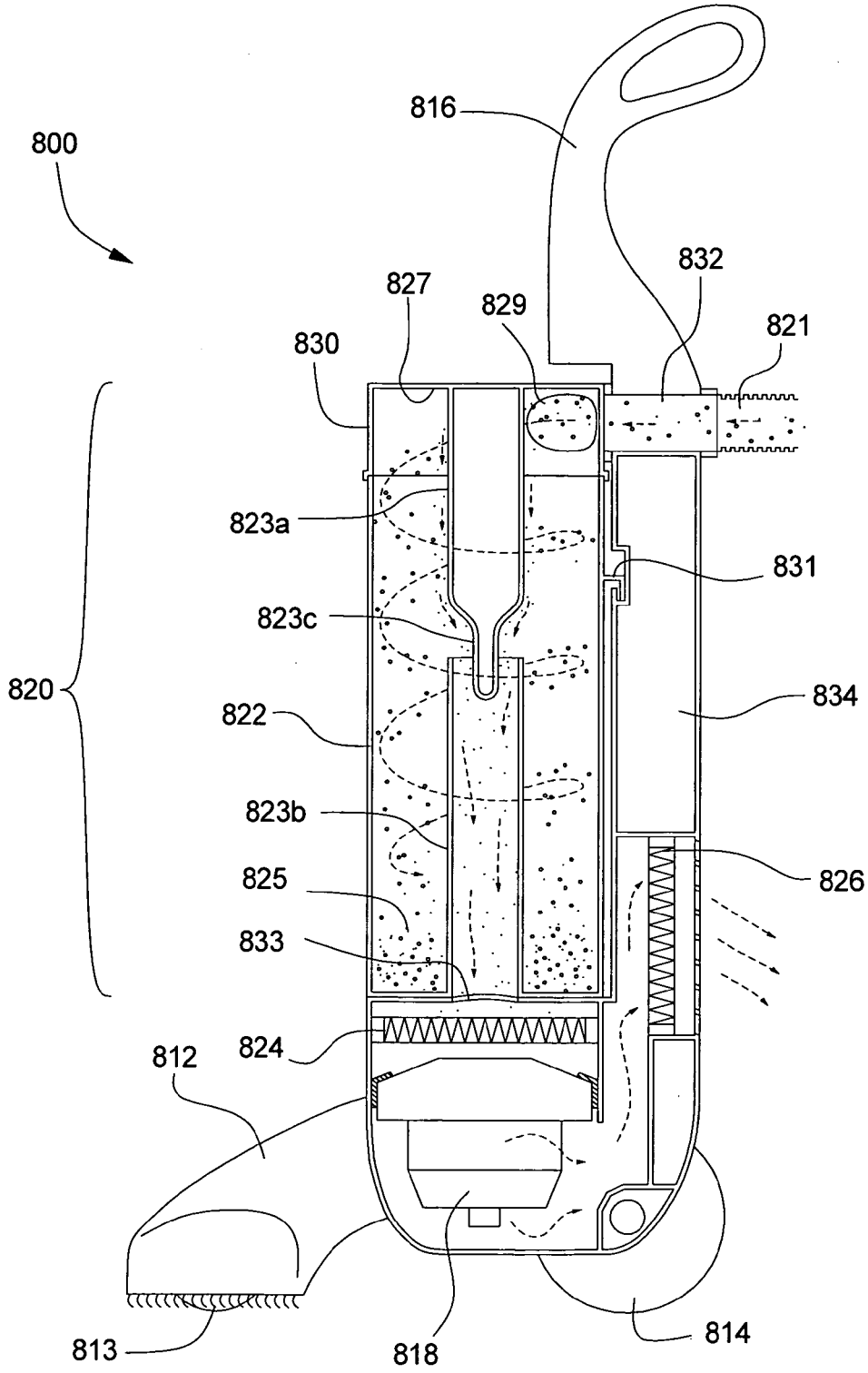
FIG. 8 is a partial cross-sectional schematic of an upright vacuum cleaner incorporating the dust separation system according to a further preferred embodiment.

FIG. 8 depicts still another embodiment of the invention. In this embodiment, the invention comprises an upright vacuum cleaner 800, having the general functional features of the vacuum illustrated in FIG. 1. Namely, the device 800 includes a nozzle 812, wheels 814, handle 816, dust separation system 820, and a suction motor 818 having pre- and post-motor filters 824, 826. The nozzle 812 of this or other embodiments may include a brushroll 813 or other type of agitator, as are known in the art.

The embodiment of FIG. 8 is arranged such that the separation chamber 822 and collection chamber 825 are manufactured from a single integrally formed piece. Part of this single piece may also form the lower tube 823*b* of the central obstruction. A selectively removable cover 830 forms both the upper surface 827 of the separation chamber 822, and may also form the inlet 829, as shown. It will be appreciated that the actual separation effect may occur in both the separation chamber 822 and the collection chamber 825. In fact, dirt collected in the collection chamber 825 may even act as a filter to help remove particles from the air as the air flows through the dirt.

The combined separation and collection chamber 822, 825 and cover 830 are held in place to the handle frame 834 by a hook 831 or other latching devices, as are well-known in the art. When the cover 830 and separation/collection chamber are installed, the bottom of the lower tube 823*b* rests above, and in fluid communication with, the inlet to the suction motor 818, and the chamber entry port 829 abuts a passage 832 to which the hose 821 is connected. These junctions may be sealed, such as by rubber or foam gaskets or o-rings, to provide a better fluid seal between the parts. The inlet to the suction motor 818 may also be provided with a screen 833 to stop very large debris from entering the motor 818, should the device be operated when it is overfilled or during other malfunctions. This screen 833 may also be positioned between the pre-motor filter 824 and the motor inlet to catch the filter if it becomes dislodged or fragmented.

Of course, other features may be added to the embodiment of FIG. 8 or other embodiments of the invention. For example, the handle frame 834 (to which the nozzle 812 is pivotally mounted) may be adapted to hold the hose 821 and various accessory cleaning tools. Also, while the suction motor 818 is shown being mounted in the handle portion of the vacuum 800, it may instead be mounted within the nozzle 812, and connected to the separation chamber outlet tube 823*b* by a pivoting or flexible conduit. The separation system 820 may also be mounted to the nozzle 812. The suction motor 818 and dust separation system 820 may also be removably mounted to the handle frame 834 and nozzle 812 to be used as a separate portable unit. The hose 821 may also be replaced by a rigid conduit formed as part of, or held within, the handle frame 834. The vacuum 800 may also have a fluid deposition and recovery system to act as a wet extractor, or be configured as a hand-held cleaner, as a stick vacuum, or as a canister cleaner (as in FIGS. 6 and 7). These modification provided as non-limiting examples, and other modifications to incorporate other known or as-yet undeveloped features of cleaning devices will be understood by those of ordinary skill in the art.

Figure 9:
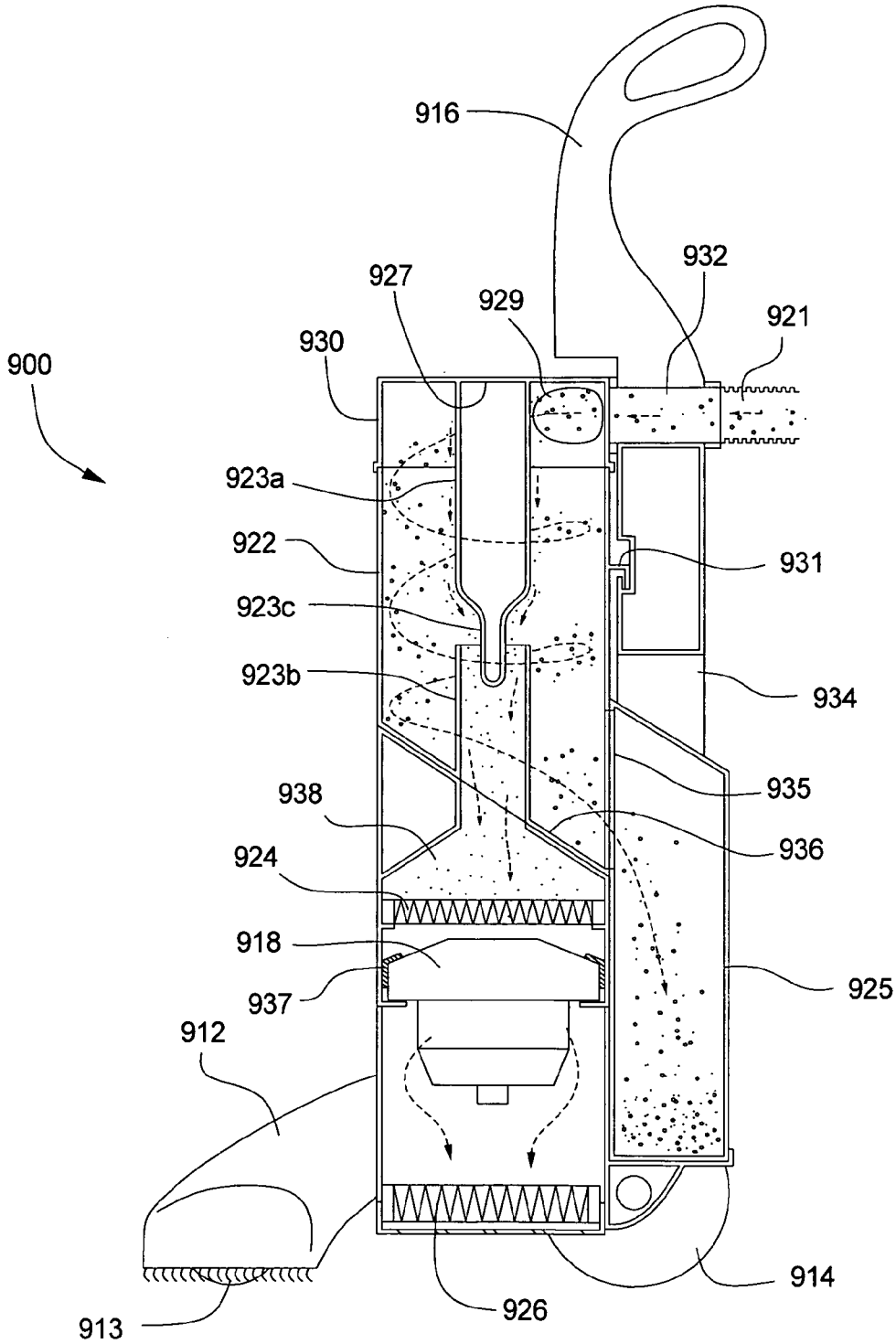
FIG. 9 is a partial cross-sectional schematic of an upright vacuum cleaner incorporating the dust separation system according to a further preferred embodiment.

Another embodiment of the invention is illustrated in FIG. 9. This device 900 is similar to the embodiment of FIG. 8, and includes a nozzle 912 with a brushroll 913, wheels 914, handle 916, dust separation system 920, and a suction motor 918 having pre- and post-motor filters 924, 926. The device 900 also includes a separation chamber 922 in which a dust separator having upper and lower tubes 923*a*, 923*b* and a vortex controller 923*c* is disposed to generate a dust-separating airflow. The tangential entry port 929 to the separation chamber 922 is provided on the chamber's cover 930. Of course, the entry port 929 could instead enter through the top 927 of the separation chamber 922, or could be an opening through the side wall of the separation chamber 922 itself (rather that being in the cover 930). A top-entry cyclone inlet would comprise a passage that receives air from above, rather than the side, and directs the air in a spiraling downward path into the separation chamber. Such entry passages are known in the art.

The collection chamber 925 is offset to the side of the separation chamber 922, and dust and debris separated from the airflow passes into the collection chamber 925 through an opening 935 between and the two chambers. The dust and dirt may be projected into the collection chamber 925 by inertia, and/or may settle on the tilted lower wall 936 of the separation chamber 922 and slide down this wall 936 into the collection chamber under the influence of gravity or with the operator's assistance. During operation of the device 900 as an upright vacuum, the handle frame 934 and the entire dust separation system 920 typically will be tilted back in the normal manner of use for upright vacuums, in which case the lower wall 936 will be inclined even further, and little of the separated dirt and dust will tend to adhere thereto. Because of this, the lower wall 936 need not be inclined, and may instead be flat (as in FIG. 8). However, having an inclined wall 936 should help transfer dirt to the collection chamber 925 when the vacuum 900 is used with an accessory cleaning tool, in which case the handle frame 934 typically remains upright while the vacuum 900 is being operated.

While the inclined lower wall 936 is shown in this embodiment with its lower edge towards the rear of the vacuum 900, this is not strictly required. The lower wall 936 may instead be inclined in other directions, depending on the desired location of the collection chamber 925 (which may be anywhere around the separation chamber 922, or even remotely located). In such instances, while the dirt may not move as readily towards the collection chamber when the device is used in the normal upright cleaning mode (in which the handle frame 934 is tilted backwards), it will still transfer to the collection chamber 925 when the handle frame 934 is tilted upright. Also, the lower wall 936 may have a shape other than the simple planar shape shown in FIG. 9. For example, the lower wall 936 may be curved in one or more planes, or may have a conical or hyperbolic shape, and may be arranged to feed into multiple collection chambers.

The sloped lower wall 936 of this embodiment conveniently provides room between the separation chamber 922 and the suction motor 918 for an expansion plenum 938, in which the airflow expands and its velocity decreases. This plenum increases the available surface area of the pre-motor filter 924, and the reduced air velocity may provide better filter performance and endurance. The shape of the plenum 938 may be adjusted to smooth the airflow to reduce noise or provide other benefits.

It is believed that vibration caused by the suction motor 918 as it operates may help dirt and dust slide down the lower wall 936. As such, while the suction motor 918 may normally be mounted through a vibration isolating ring 937 or other vibration-reducing surface, this may optionally be removed to provide enhanced vibration assistance to help slide dirt into the collection chamber 925. It is also envisioned that the isolation ring 937 can be used, but a direct mechanical link, such as a simple rigid rod, may be positioned between the housing of the suction motor 918 and the vacuum housing proximal to the lower wall 936 to transmit vibration thereto. This link may be in place at all times, or selectively engaged only when assistance with removing dirt from the lower wall 936 is desired. The lower wall 936 may also incorporate its own vibrator to provide enhanced dirt movement therefrom.

The present invention also provides for using multiple dust separators in parallel (that is, operating to separately clean separate airflows or a single divided airflow). One preferred embodiment of a parallel flow device is shown in FIGS. 10 through 15. This separation device 1000, which may be used with an upright, canister, or other type of vacuum, comprises multiple dust separators 1001 that are arranged centrally within a housing 1002 (which may be transparent). Each dust separator 1001 comprises an outer wall 1003 (which is preferably cylindrical) having a separate separation system contained therein. These individual separation systems are similar to those described previously herein, and each includes an upper tube-like obstruction 1023*a* that is axially aligned with a hollow lower tube 1023*b*, with a vortex controller 1023*c* positioned at the end of the upper tube 1023*a* to guide the airflow into the lower tube 1023*b*. A separation chamber 1022 is formed between the upper and lower tubes 1023*a*, 1023*b* and the outer wall 1003, and terminates at a sloped lower wall 1036. Each separation chamber 1022 exits through an opening 1035 into a collection chamber 1025 formed in the housing 1002. The lower tubes 1023*b* terminate at an outlet tube 1007 that is fluidly joined with a suction motor 1018. The outlet tube 1007 preferably is shaped to efficiently collect the airflows from the lower tubes 1023*b*, as will be appreciated by those of ordinary skill in the art.

The dust separators 1001 are suspended from a cover 1030 that seals the upper end of the housing 1002, and are provided with a flow of dirty air by an entry port 1029 located on the top of the cover 1030. The entry port 1029 divides the incoming airflow into a separate stream for each dust separator 1001 (which in this embodiment number four), and preferably is shaped to divide the airflow efficiently and evenly between the separators 1001. In the shown embodiment, the entry port 1029 comprises a cylindrical inlet having four dividing walls 1004 that divide the entry port into four sections. Each section feeds incoming air into a respective conduit 1006. A central cone 1005 (having a conical or curved profile) may also be positioned within the entry port 1029 to help the air bend into the conduits 1006. Each conduit 1006 feeds incoming air to a respective separator 1001. The conduits 1006 preferably are shaped as downwardly-spiraling passages that terminate adjacent the upper tube 1023*a* of each separator 1001. In such a case, the upper tube 1023*a* may form the inner wall of each passage. However, any other configuration that provides the air to the separators 1001 in a tangential fashion could instead be used.

The various parts of this device 1000 may be constructed in any suitable manner. In a preferred embodiment, the cover 1030, entry port 1029 (and associated parts), conduits 1006, upper tubes 1023*a* and vortex controllers 1023*c* are provided as a first part. The lower tubes 1023*b*, outer walls 1003, and the lower surfaces 1036 of the separation chambers 1022 are formed as a second part. The outer housing 1002 and outlet tube 1007 are formed as a third part, which holds the first and second parts on top of a vacuum housing 1008. Any fitment arrangement can be used to retain these parts on the vacuum housing 1008. The parts of this or other embodiments may also be provided as a retrofit kit that can be used to replace the bag or bagless separator of an existing vacuum cleaner.

In use, dirty air enters the entry port 1029 and divided into four separate streams. Each separate stream enters a respective separator 1001, where dirt, dust and other contaminants are removed as described previously herein. This provides multiple parallel dirt cleaning operations. The cleaned air passes through the lower tubes 1023*b* and into the outlet tube 1007, where it is drawn into the suction motor 1018. In this embodiment, dirt can be removed from the collection chamber 1025 by removing the cover 1030 and its associated parts, optionally removing the second part (the conjoined lower tubes 1023*b*, outer walls 1003, and the lower surfaces 1036), and inverting the housing 1002.

Figure 16:
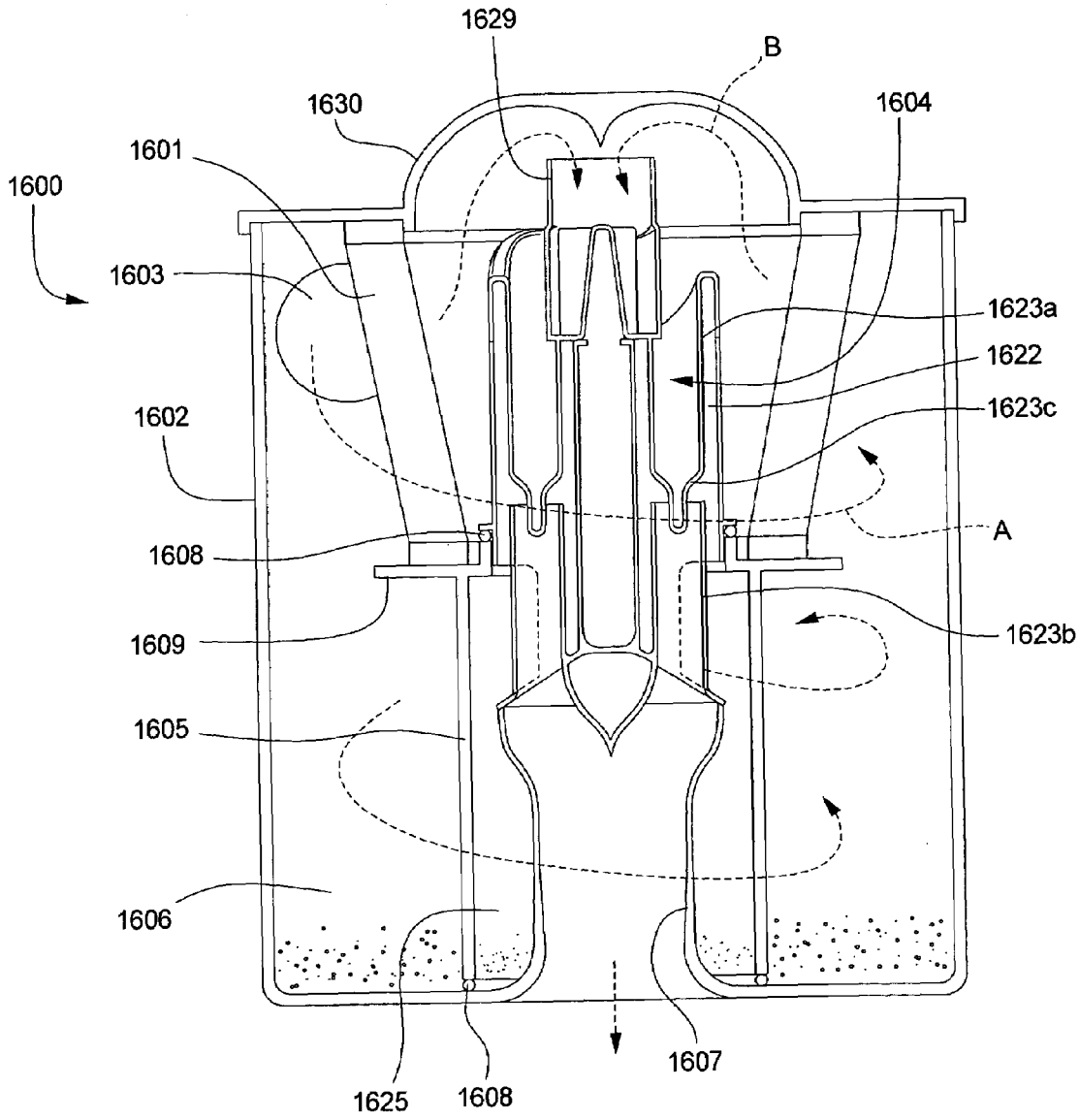
FIG. 16 is a cutaway side view of another preferred embodiment of a dust separation system of the invention.

The present invention may also be used in series with other dirt separators as part of a multi-stage cleaning system. One preferred embodiment of a series system 1600 is shown in FIG. 16. In this embodiment, the device 1600 comprises a conventional first cleaning stage comprising a main filter 1601 (or screen or perforated surface) located approximately along the centerline of a cylindrical housing 1602. The upper end of the cylindrical housing 1602 is sealed by a cover 1630. A main entry port 1603 provides dirty air into the housing 1602 in a tangential manner to establish a cyclonic airflow (arrow A) that tends to separate particles that are entrained in the air. The air eventually passes through the filter 1601 and flows to the entry port 1629 of the second cleaning stage 1604, as shown by arrow B. The second cleaning stage 1604 may comprise the device described with reference to FIGS. 10 through 15 or any other device of the present invention. As before, the second cleaning stage rests on and exits out of an outlet tube 1607, which is preferably integrally formed with the housing 1602. One particular advantage of this embodiment is that the second cleaning stage is located concentrically within the first stage, which reduces the overall size of the device.

To prevent air from bypassing the main filter 1601 before it enters the second stage entry port 1029, the main filter 1601 is mounted on a skirt-like structure 1605 that extends from the bottom of the filter 1601 to the lower surface of the housing 1602. The skirt 1605 may have a radial protrusion 1609 that may help prevent dirt from impinging on the filter 1601 or becoming re-entrained in the airflow. The volume of the lower housing 1602 between its outer wall and the skirt 1605 serves as the main collection chamber 1606 for debris removed from the airflow in the first cleaning stage. The volume of the lower housing 1602 between the skirt and the outlet tube 1607 forms the secondary collection chamber 1625 for the second cleaning stage 1604. Seals 1608 may provided between the skirt 1605 and housing 1602 and other parts to minimize airflow that bypasses the main filter 1601.

While such seals may comprise resilient members, such as rubber or foam o-rings or gaskets, or labyrinthine seals, these seals 1608 may simply be formed by abutment or close tolerances between the parts.

The filter 1601 of this embodiment preferably comprises a foam filter or a filter formed from a pleated paper, cloth or synthetic material, and may be a HEPA-grade filter. The filter may also be replaced by a simple fine-mesh or coarse-mesh screen or perforated surface. Also, while the filter 1601 is shown as having a frustro-conical shape, it may instead have a curved or cylindrical profile.

This embodiment is expected to yield particularly good dirt separation results. The use of the filter 1601 (or a screen) as a first cleaning stage limits the types of particles that the second stage separators 1604 are required to remove from the airflow. As such, the shapes of the second stage closed tube 1623*a*, hollow tube 1623*b*, vortex controller 1623*c* and separation chamber 1622 can be tailored to remove particles having a predetermined maximum size. By narrowing the range of sizes that need to be separated by the second stage, it may be possible to improve the efficiency of the second stage separators 1604, thereby improving overall separation efficiency of the system 1600.

Figure 17:
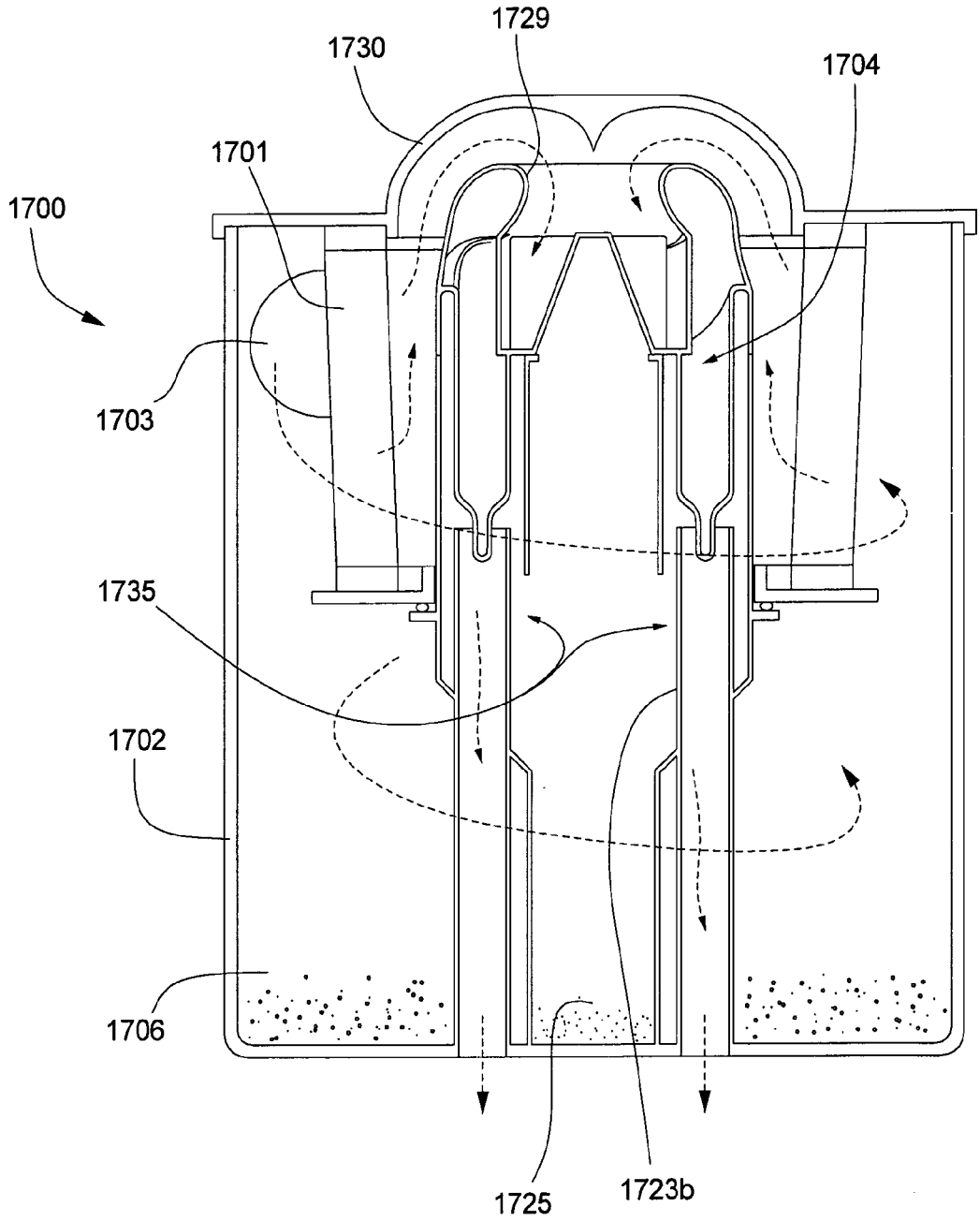
FIG. 17 is a cutaway side view of still another preferred embodiment of a dust separation system of the invention.

A variation on the embodiment of FIG. 16 is shown in FIG. 17. In this embodiment, the first cleaning stage comprises a main filter 1701 (or screen) located in a housing 1902 with a tangential inlet 1703 and a cover 1730. The first cleaning stage operates as described with reference to FIG. 16, and deposits dirt into a main collection chamber 1706. The second cleaning stage 1704 is similar to the embodiments of FIGS. 10 and 16, but the individual dust separators have been spaced apart and rotated such that their openings 735 project into a secondary collection chamber 1725 located at the center of a ring formed between the dust separators. Using this construction, it is not necessary to provide a skirt-like structure, as in FIG. 16, to separate the two collection chambers to prevent air from bypassing the first stage filter 1701.

In this embodiment, the lower tubes 1723*b* of the second stage dust separators may remain separate until they exit the housing 1702, at which point they may be joined to feed into the suction motor (not shown), or may separately enter the suction motor. Of course, the lower tubes 1723*b* may be joined within the confines of the housing 1702, but this may lead to additional manufacturing costs. Also in this embodiment, the second stage entry port 1729 has been contoured such that it promotes unrestricted airflow from the filter 1901 to the dust separators. Of course, this contouring may be done with other embodiments as well.

Figure 10:
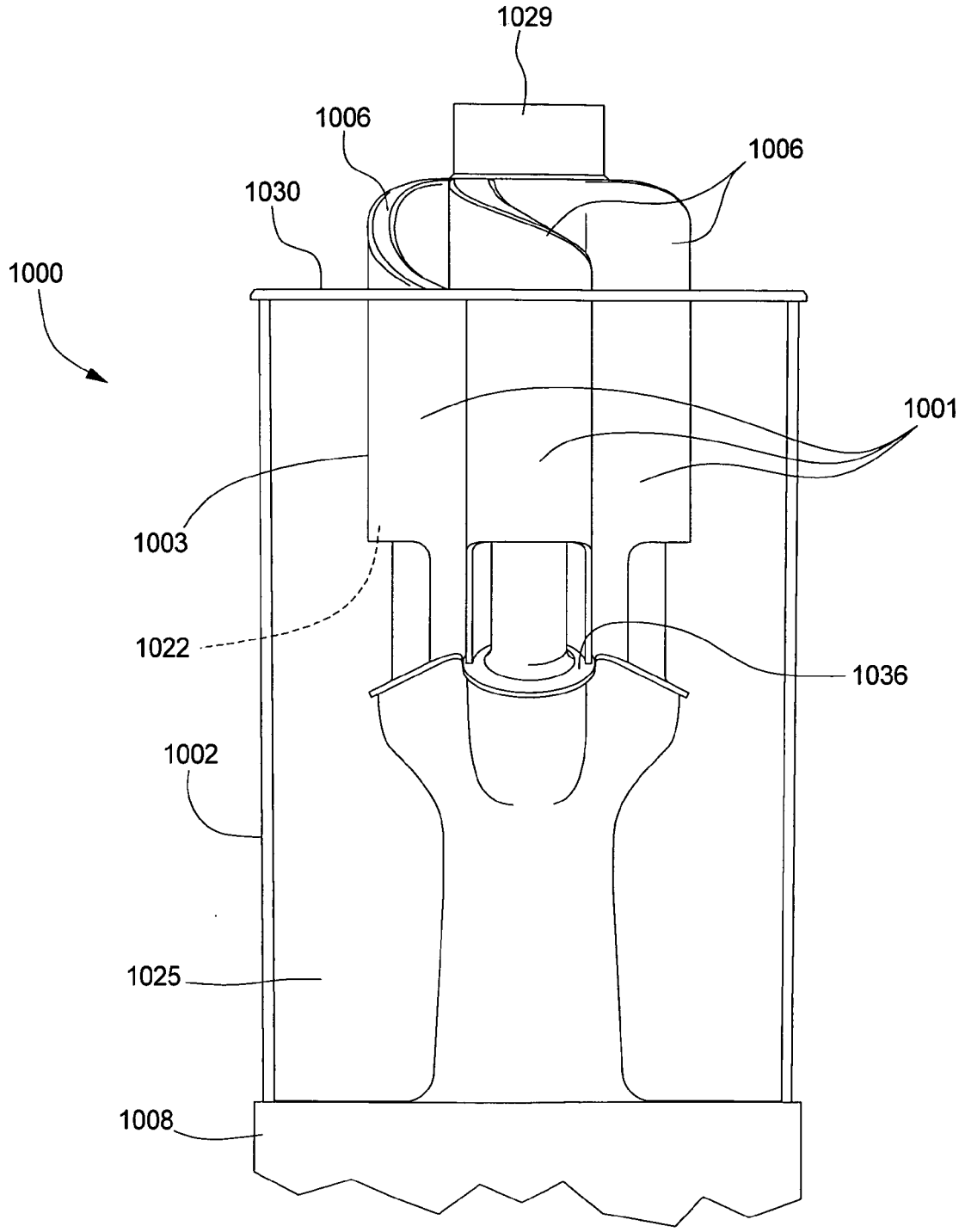
FIG. 10 is a side view of an upright vacuum cleaner incorporating the dust separation system according to a further preferred embodiment.

It will also be understood that the second cleaning stage shown in FIG. 17 may be used independently of the first stage, as in the embodiments of FIGS. 16 and 10.

Figure 18A:
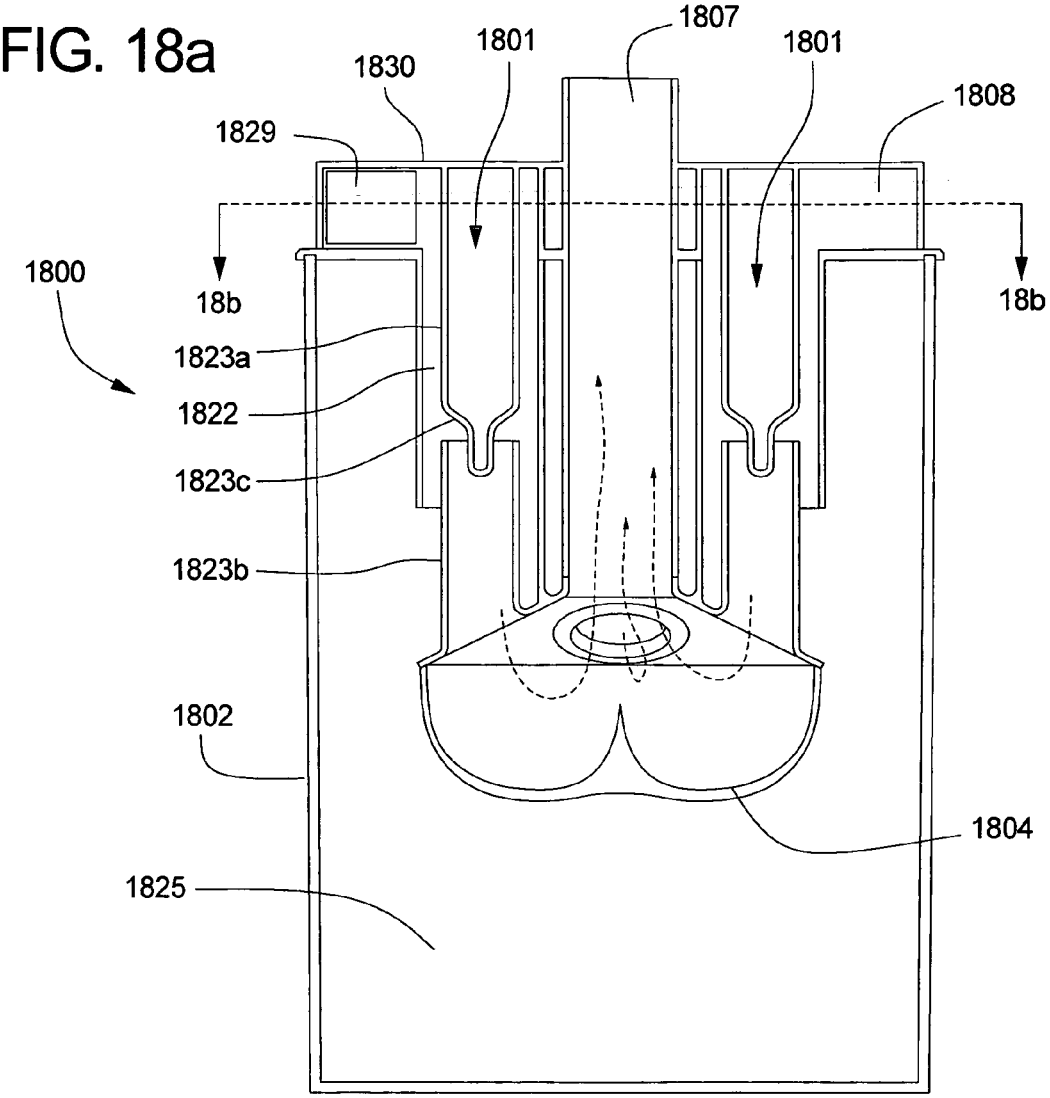
FIG. 18*a* is a cutaway side view of yet another preferred embodiment of a dust separation system of the invention.
Figure 18B:
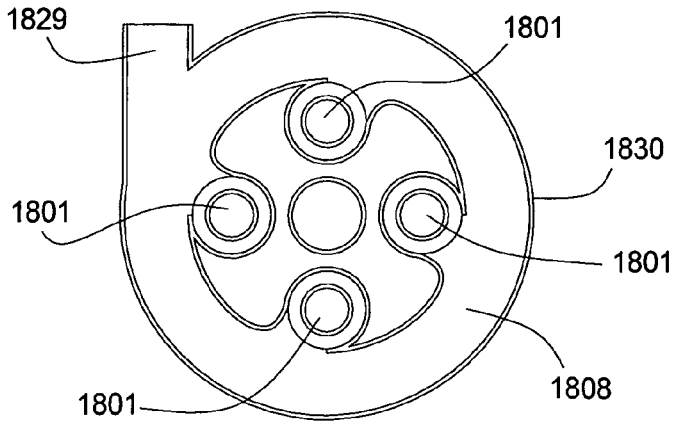
FIG. 18*b* is a cutaway top view of the embodiment of FIG. 18*a*, as viewed from reference line 18*b*—18*b* of FIG. 18*a*.

Referring now to FIG. 18, another aspect of the invention provides a parallel flow filtration system, as in the embodiment of FIG. 10 (and the second stage separators of FIGS. 16 and 17), in which the airflow exits the device through the top, rather than the bottom of the housing. This device 1800 comprises a housing 1802 in which a plurality of dust separators 1801 are suspended. The lower portion of the housing 1802 forms a collection chamber 1825, and the upper end of the housing 1802 is closed by a cover 1830. The dust separators 1802 are structurally the same as those of FIG. 10, but are spaced apart somewhat to accommodate an outlet tube 1807 formed between them. A suction motor (not shown) draws the air through the lower tubes 1823*b*, through a manifold 1804 (which is preferably shaped to encourage smooth airflow), and out of the outlet tube 1807. The entry port 1829 of this embodiment is in the cover 1830, and it feeds into an annular chamber 1808 that supplies dirty air to each of the dust separators 1801. The annular chamber 1808 may be shaped or provided with baffles or screens to help distribute the air evenly to the four dust separators. Of course, the number of separators may be varied according with different embodiments of the invention. It will be appreciated that this device 1800 may be used in lieu of the second stage separators shown in FIGS. 16 and 17, and any other embodiments of the invention, where appropriate.

Figure 19A:
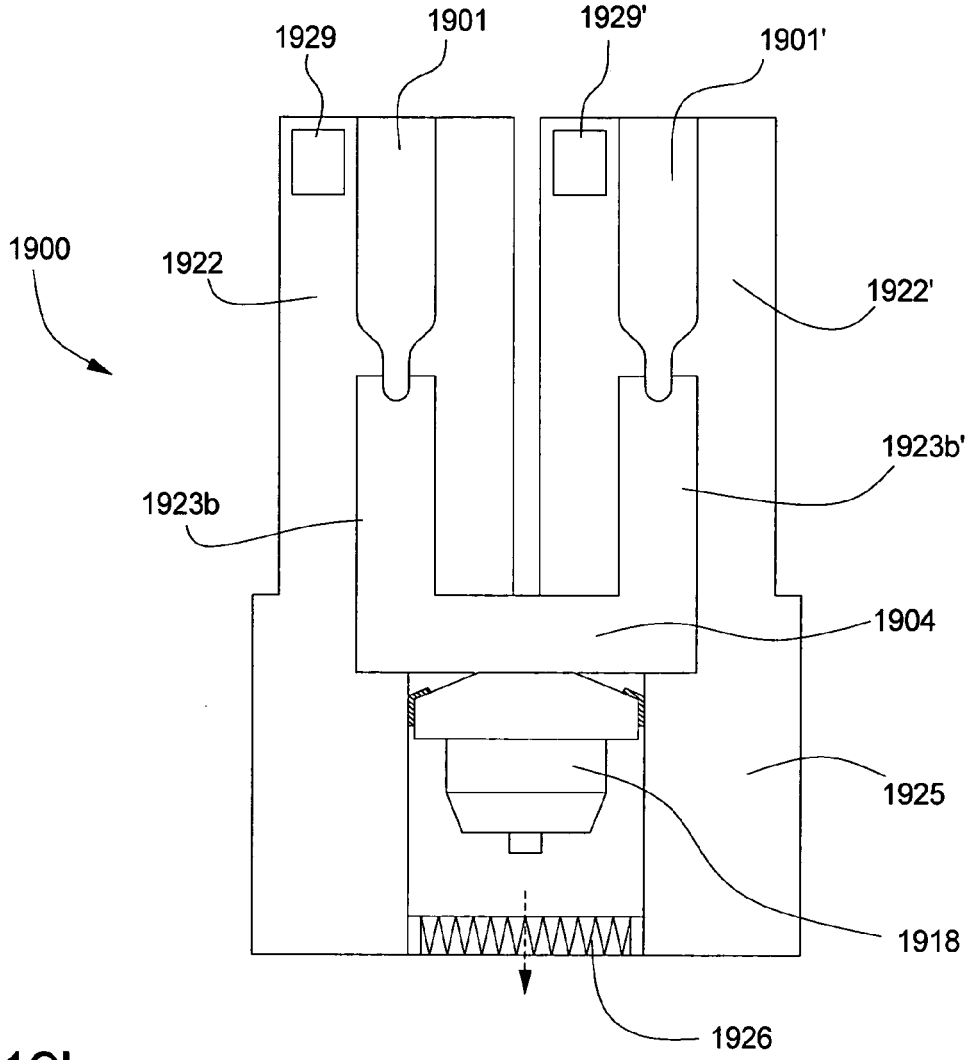
FIGS. 19*a* and *b* are side and top schematic views, respectively, of another preferred embodiment of a dust separation system of the invention.
Figure 19B:
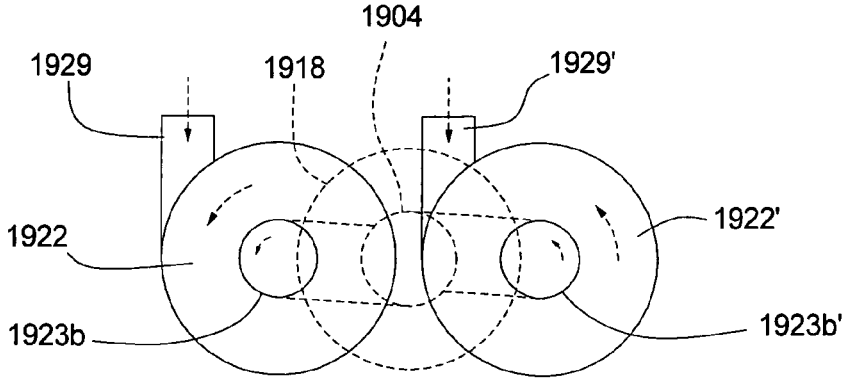

Another embodiment of the invention is shown in FIGS. 19*a* and 19*b*. In this embodiment, the invention comprises a parallel-flow separation system 1900 having two separators 1901, 1901'. Each separator is housed in a corresponding separation chamber 1922, 1922' having its own tangential entry port 1929, 1929'. Each separator 1901, 1901' has a lower outlet tube 1923*b*, 1923*b'*, which join together in a manifold 1904 prior to the suction motor 1918. A single collection chamber 1925 is placed below both separators to collect the removed dirt and debris. The separators 1901, 1901' may be arranged such that the air flows within them in the same direction, such as both having counterclockwise flow (as shown), or they may have opposite flow directions.

Figure 20A:
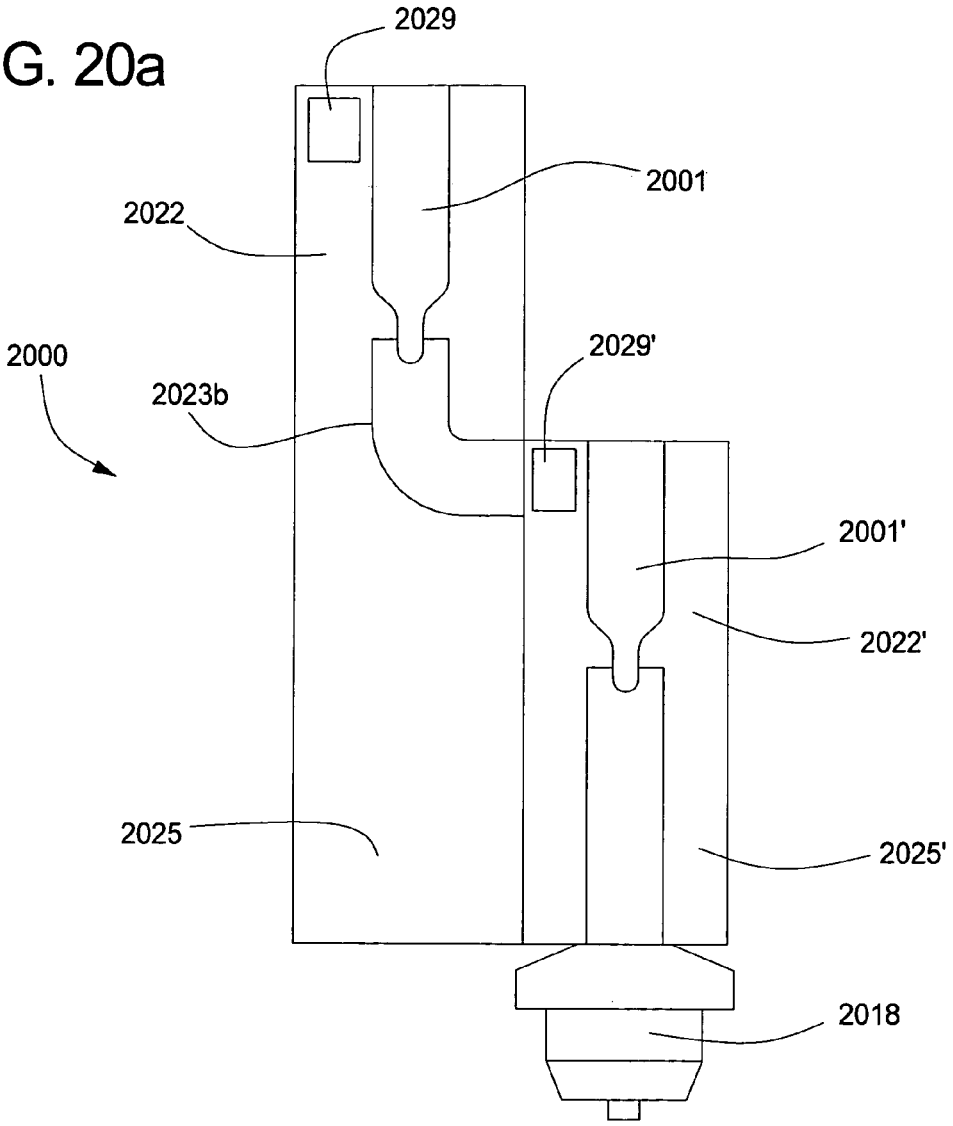
FIGS. 20*a* and *b* are side and top schematic views, respectively, of another preferred embodiment of a dust separation system of the invention.
Figure 20B:
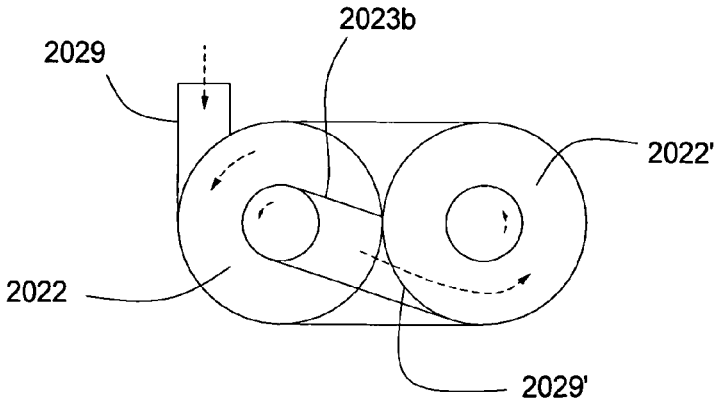

Another embodiment of the invention is shown in FIGS. 20*a* and 20*b*. In this embodiment, the invention comprises a series-flow separation system 2000 having a first separator 2001 and a second separator 2001'. In this embodiment the outlet 2023*b* of the first separator 2001 directs air tangentially through the entry port 2029' of the second separator 2001.' Each separator 2001, 2001' has its own separation chamber 2022, 2022' and collection chamber 2025, 2025'. In this embodiment, either the first or second separator 2001, 2001' may be replaced by a conventional cyclonic separator, and the second separator 2001' may also be replaced by a filter bag. Also, while the two separators 2001, 2001' are shown offset from one another, they may instead be arranged generally coaxially.

Figure 21A:
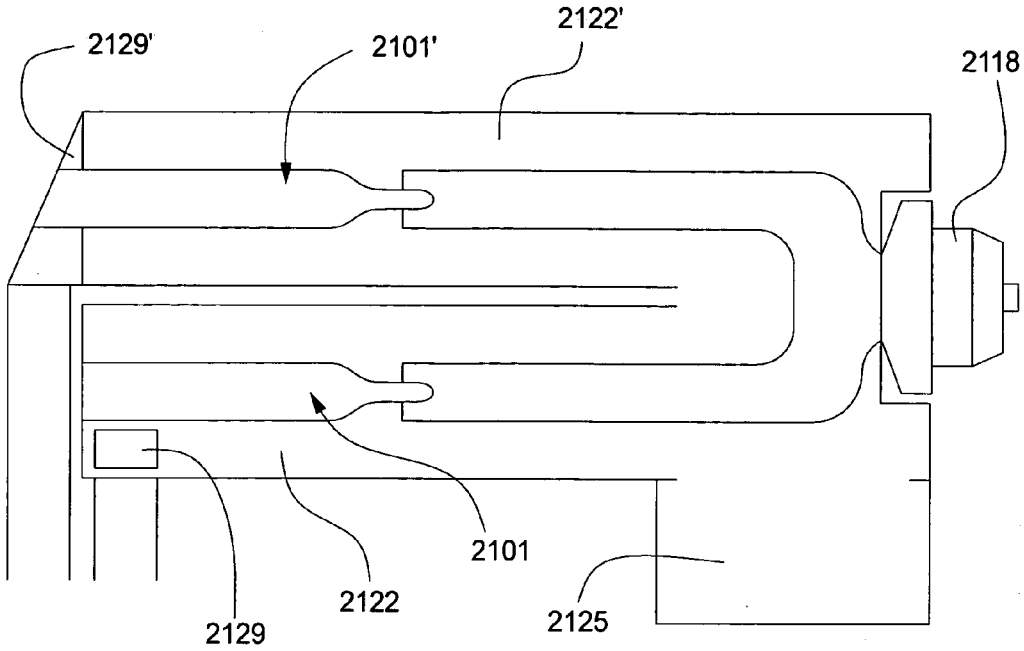
FIGS. 21*a* and *b* are side and front schematic views, respectively, of still another preferred embodiment of a dust separation system of the invention.
Figure 21B:
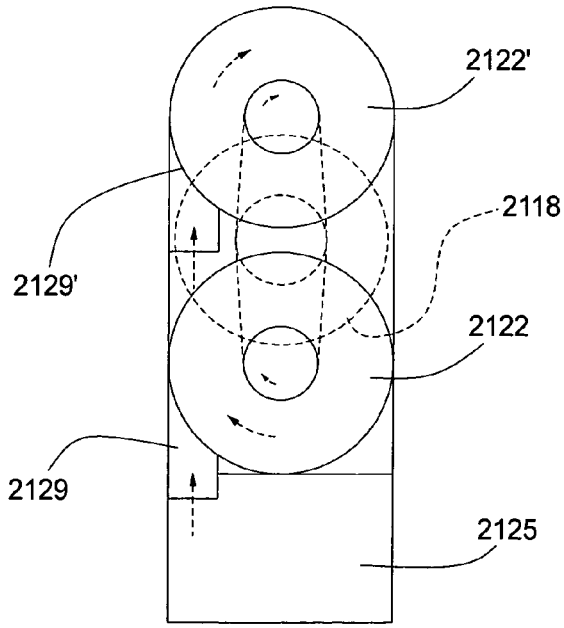

Another embodiment of the invention is shown in FIGS. 21*a* and 21*b*. In this embodiment, the invention comprises a parallel-flow separation system 2100, similar to that of FIG. 19*a*, but this system 2100 is arranged such that the separators 2101, 2101' are horizontal. The separators 2101, 2101' deposit dirt and debris into a common collection chamber 2125 located opposite the entry ports 2029, 2029'. As with the embodiment of FIG. 21*a*, the separators 2101, 2101' are operated by a single suction source 2118, but multiple suction sources may instead be used for this or other embodiments.

Figure 22:
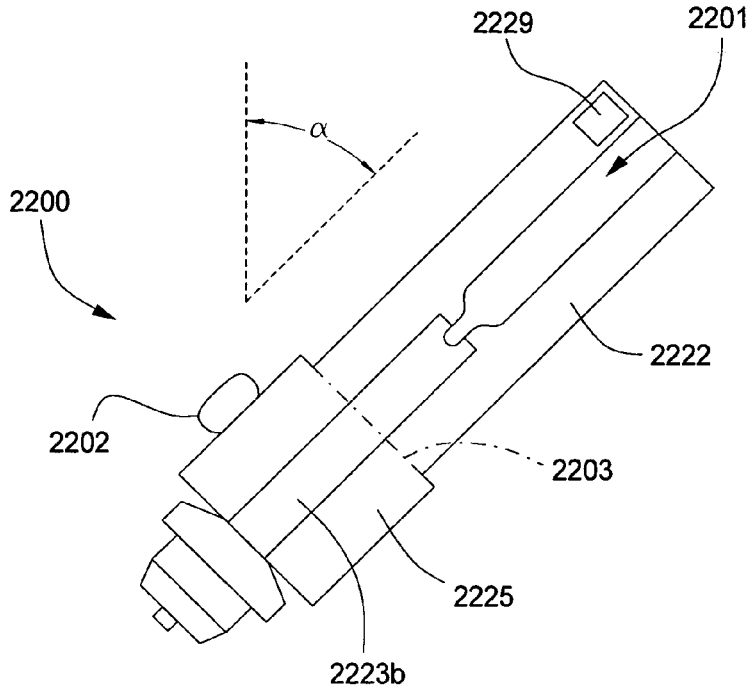
FIG. 22 is a side schematic view of another preferred embodiment of a dust separation system of the invention.
Figure 23:
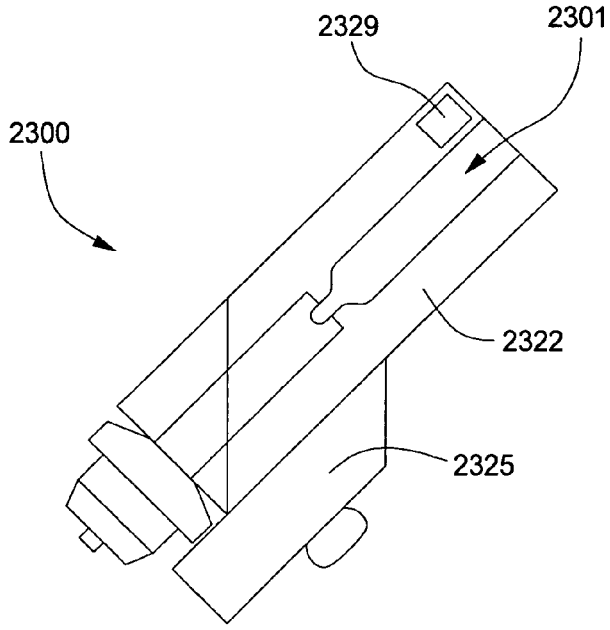
FIG. 23 is a side schematic view of yet another preferred embodiment of a dust separation system of the invention.

It will be appreciated that a separator of the present invention may be used in vertical and horizontal orientations. The separator may also be angled, as shown in the embodiments of FIGS. 22 and 23. The separation system 2200 of FIG. 22 comprises one or more separators 2201 as described previously herein having a collection chamber 2225 removably mounted below the separation chamber 2222. A handle 2202 is provided to assist with removing the collection chamber. In this embodiment, the lowermost portion of the lower tube 2223*b* may be removable with the collection chamber, as shown by the parting line 2203. The separation system 2300 of FIG. 23 is similar to that of FIG. 22, but the collection chamber 2325 is offset from the axis of the separator 2301. In both of these embodiments, the separation system 2200, 2300 is tilted on its axis by an angle $\alpha$. This orientation may correspond to the typical leaned-back use position of an upright vacuum, as described before with reference to FIG. 9, or may be the orientation in which the separation systems 2200, 2300 are permanently or initially positioned within a cleaner, such as a canister-type cleaner. Of course, any other embodiment of the invention may likewise be oriented at an angle, vertically or horizontally.

Figure 24:
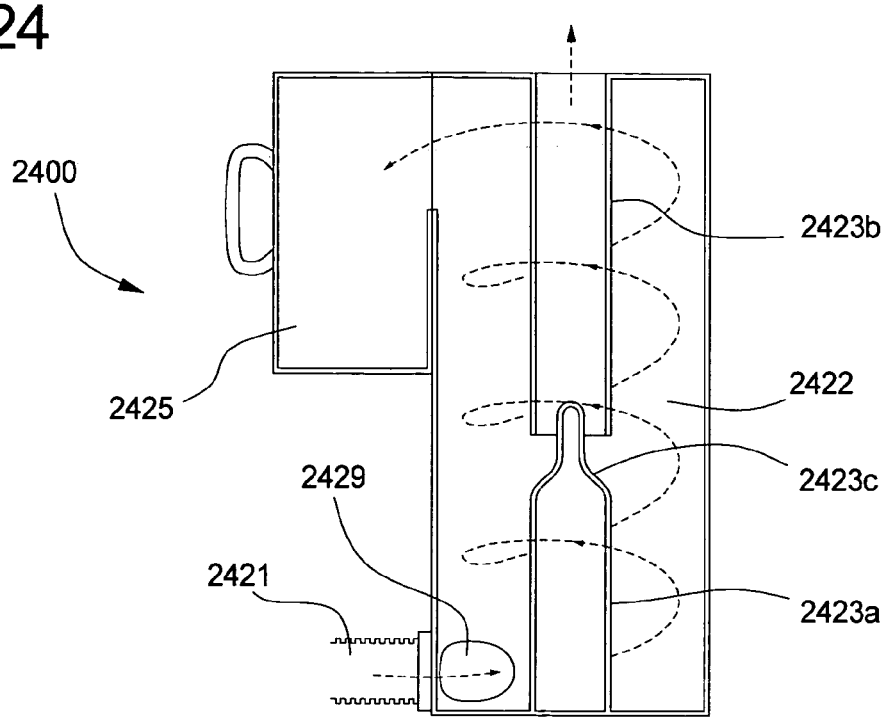
FIG. 24 is a cutaway side view of another preferred embodiment of a dust separation system of the invention.

Still another embodiment of the invention is shown in FIG. 24. In this embodiment, the separation system 2400 is inverted, with the entry port 2429 at the bottom of the separation chamber 2422, and the collection chamber 2425 located offset from the top of the separation chamber 2422. The separator is provided with a closed lower tube 2423*a* and a hollow upper tube 2423*b* that forms the air outlet. The vortex controller 2423*c* is positioned at the top of the lower tube 2423*a* and extends upwards towards or into the upper tube 2423*b*. In a variation of this embodiment, the upper and lower tubes 2423*a*, 2423*b* and vortex controller 2423*c* may instead be oriented with the hollow exit tube 2423*b* located below the closed tube 2423*a*, as in the previous embodiments.

Figure 25:
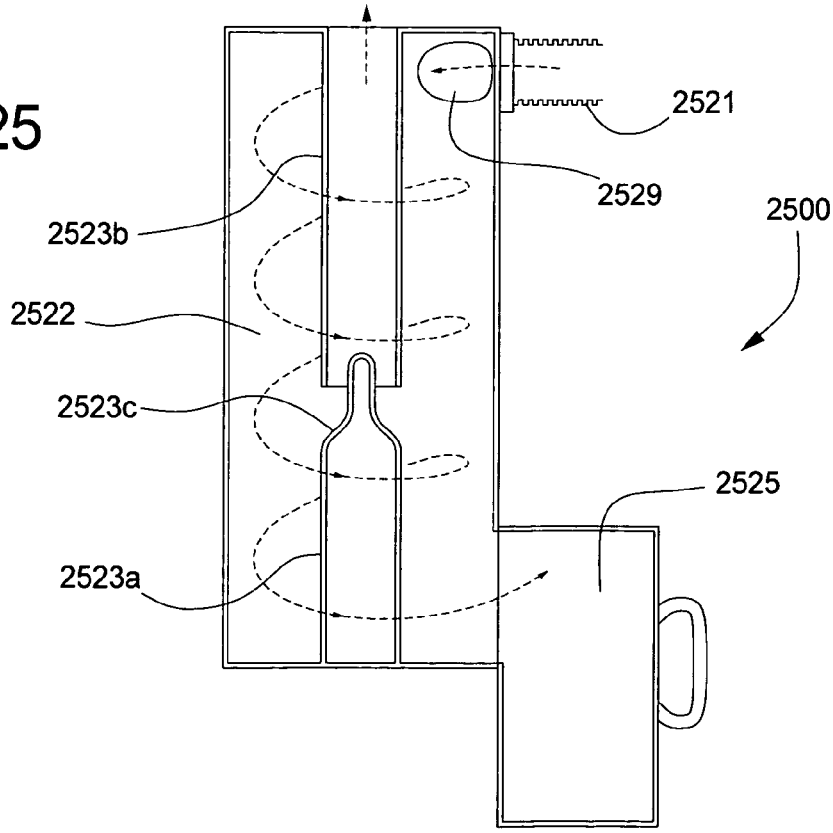
FIG. 25 is a cutaway side view of another preferred embodiment of a dust separation system of the invention.

While the forgoing embodiment completely inverts the separation system, FIG. 25 illustrates another embodiment in which the separation system 2500 is only partially inverted relative to previous embodiments. In separation system 2500, the functional elements are arranged essentially as in the embodiment of FIG. 9, but the upper and lower tubes have been inverted as described with reference to FIG. 24. In this embodiment, the lower tube 2523*a* is enclosed (or solid), and holds the vortex controller 2523*c* such that it extends towards or into the hollow upper tube 2523*b*. This embodiment, and that of FIG. 24, allow the suction motor (not shown) to be mounted immediately above the separation system, or remotely by a hose or conduit. Either of these embodiments would also be particularly useful as a capsule that fits on a vacuum hose, such as in U.S. Pat. No. 6,625,845 which is incorporated herein by reference.

Figure 26A:
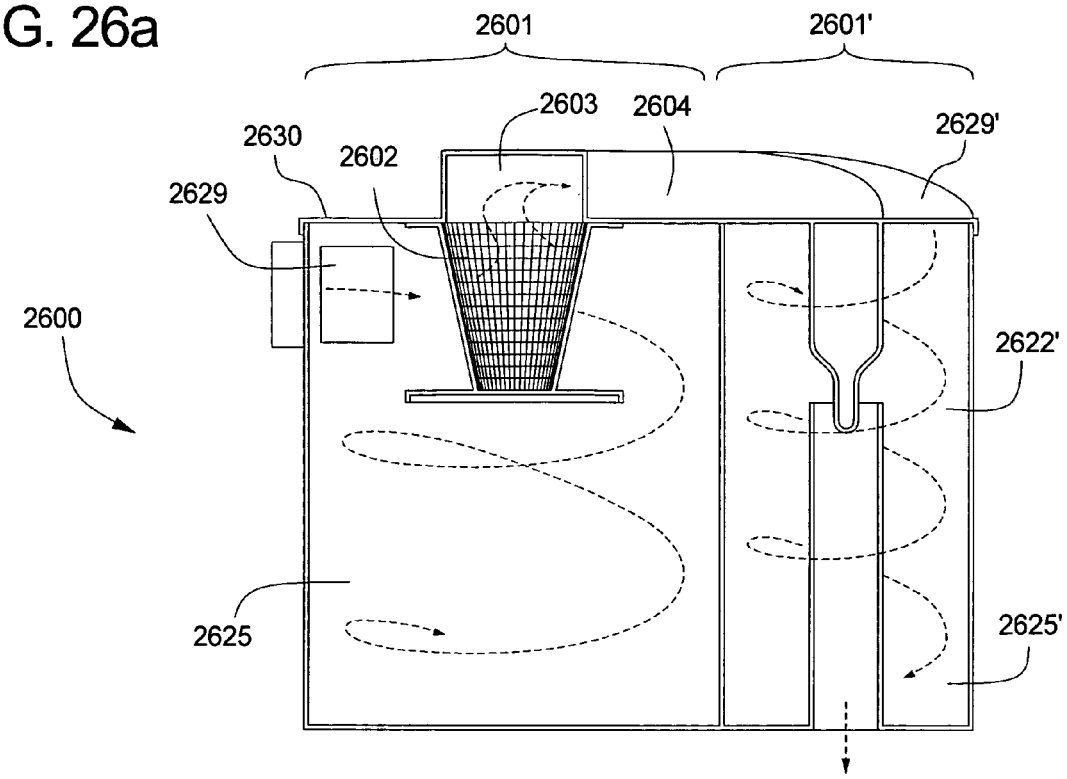
FIG. 26*a* is a cutaway side view of still another preferred embodiment of a dust separation system of the invention.
Figure 26B:
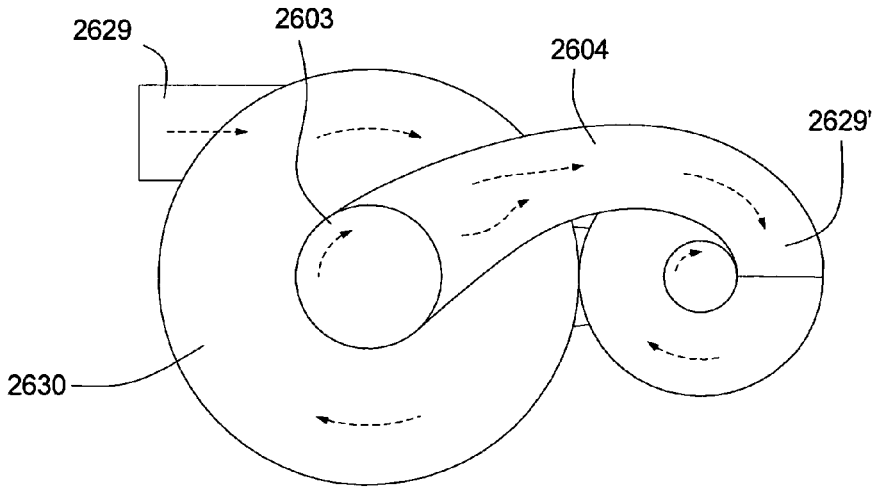
FIG. 26*b* is a top view of the embodiment of FIG. 26*a*.

Still another preferred embodiment of the invention is a series-flow, multi-stage separation system as shown in FIGS. 26*a* and 26*b*. In this embodiment, the separation system 2600 comprises a first stage separator 2601 and a second stage separator 2601', located downstream of the first separator 2601. The first stage separator 2601 comprises a conventional cyclonic separation chamber 2622 having a tangential inlet port 2629 and a filter or screen 2602 around which the air flows before exiting through the first stage outlet 2603. In a variation of this or other embodiments, the screen 2602 may also be replaced by a solid tube, and the housing in which the tube is located may be provided with a tapered surrounding wall, as shown in the separator of U.S. Pat. No. 5,935,279, which is incorporated herein by reference. Debris extracted from the airflow in the first stage is deposited into a first stage collection chamber 2625.

After leaving the first stage outlet 2603, the air travels through a conduit 2604 until it enters the second stage separator 2601' through a second stage entry port 2629'. In the shown embodiment, the second stage entry port 2629' comprises a ramped, spiraling surface that enters the top of the second stage separation chamber 2622', but it may instead be a tangential inlet or other type of inlet that promotes cyclonic flow. Dirt separated from the airstream in the second stage is deposited into a second collection chamber 2625'. The second stage separator 2601 comprises any of the co-linear tube separators described elsewhere herein.

In the embodiment of FIGS. 26*a* and 26*b*, the screen 2602 and upper tube 2623*a* of the first and second stage separators 2601, 2601' and the conduit 2604 are conveniently attached to (or formed integrally with) a cover 2630 that is removable from the separation chambers and collection chambers to facilitate emptying thereof. The conduit 2604 may also be conveniently formed as a handle by which the entire separation system 2600 or just the cover 2630 may be lifted. The two collection chambers 2625, 2625' may be separate or attached (such as by integral forming). It is also within the scope of the invention to reorder the components such that the air flows through the secondary separator of the invention first, and the first separator second.

The embodiment of FIGS. 26*a* and 26*b* operates much like the embodiment of FIGS. 16 and 17, with one difference being that the first and second separation stages are arranged laterally, rather than concentrically. This may be useful to fit the separation system within a particular profile or to provide manufacturing, cost, or maintenance benefits.

The present invention also provides multi-stage separators in which the separation stages are arranged vertically. Embodiments of vertical multi-stage separators are shown in FIGS. 27 and 28.

Figure 27:
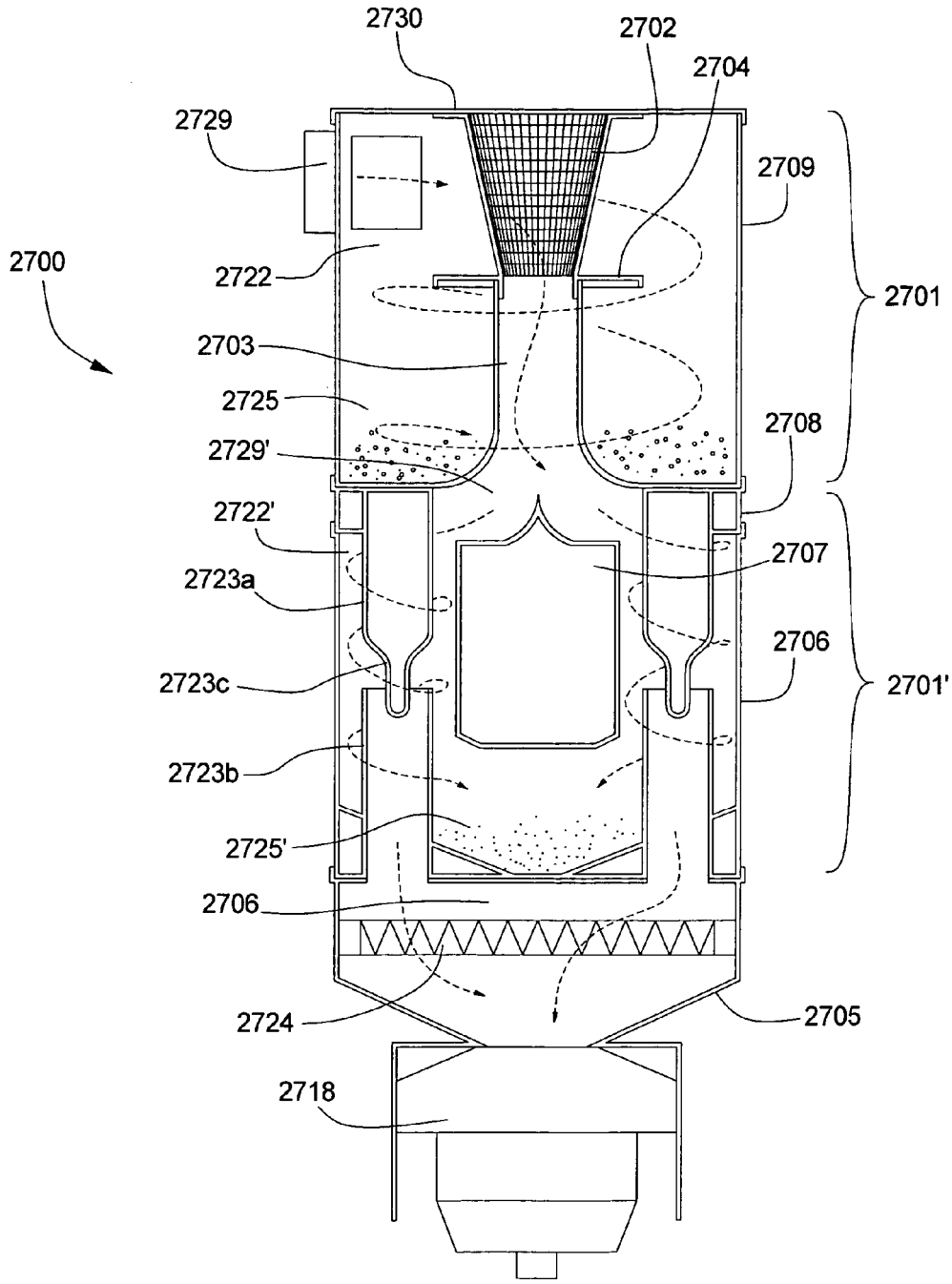
FIG. 27 is a cutaway side view of another preferred embodiment of a dust separation system of the invention.
Figure 28:
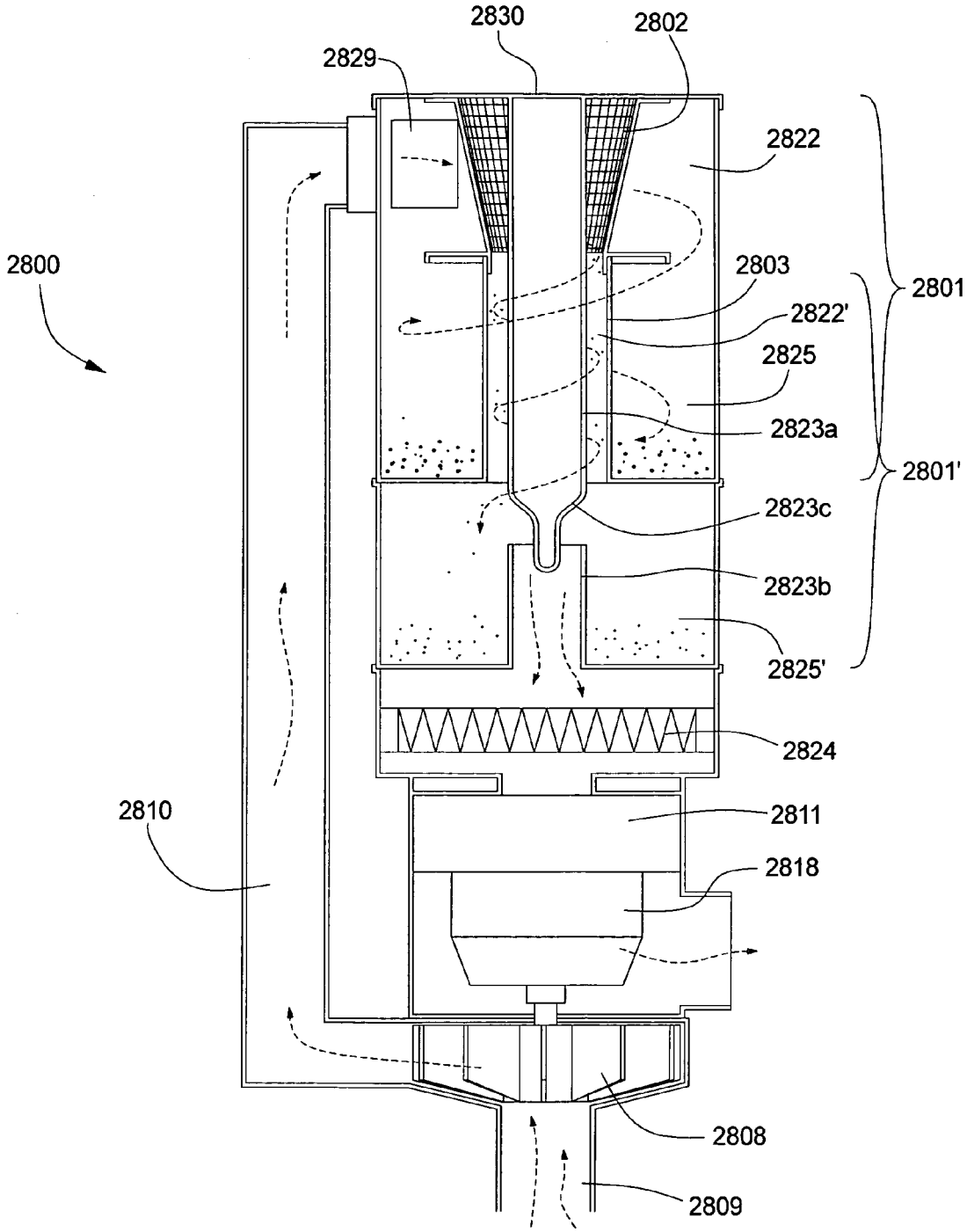
FIG. 28 is a cutaway side view of another preferred embodiment of a dust separation system of the invention.

A first embodiment of a vertically stacked multi-stage separation system is shown in FIG. 27. In this embodiment, the first stage separation system 2701 comprises a cyclonic separation chamber 2722 having a tangential inlet 2729 and a mesh screen 2702 or filter about which the dirt-laden air flows before eventually passing through a first stage outlet 2703 below the screen 2702. Dirt separated by the first stage 2701 is deposited in a first stage collection chamber 2725, and a radial protrusion 2704 may be provided at the base of the screen 2702 to help prevent dirt from lifting out of the first collection chamber 2725.

Figure 11:
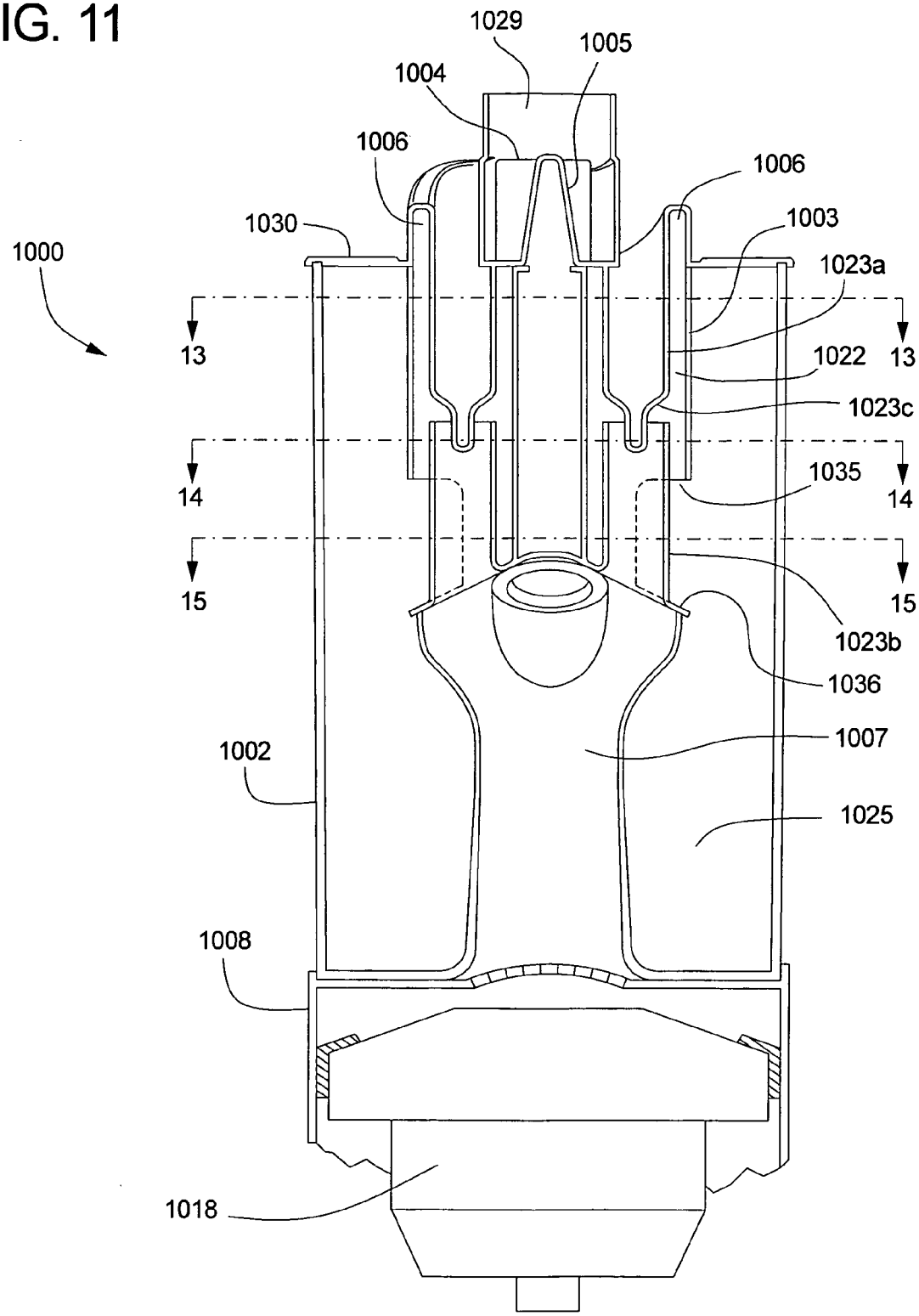
FIG. 11 is a partial cross-sectional side view of the embodiment of FIG. 10.
Figure 12:
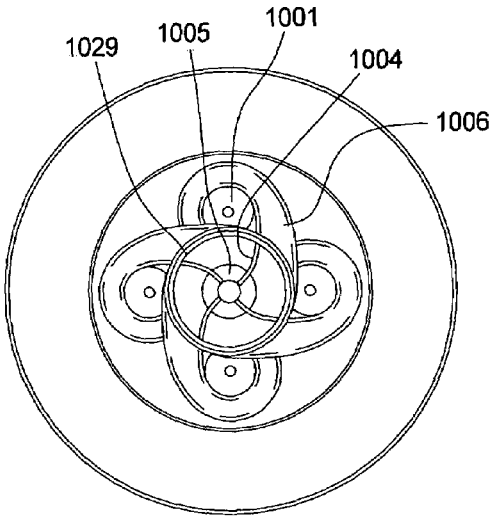
FIG. 12 is a top view of the embodiment of FIG. 10.
Figure 13:
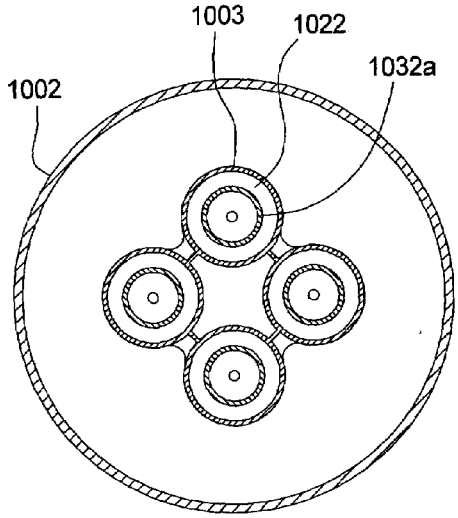
FIG. 13 is a cutaway view of the embodiment of FIGS. 10 and 11, as viewed from reference line 13—13 of FIG. 11.
Figure 14:
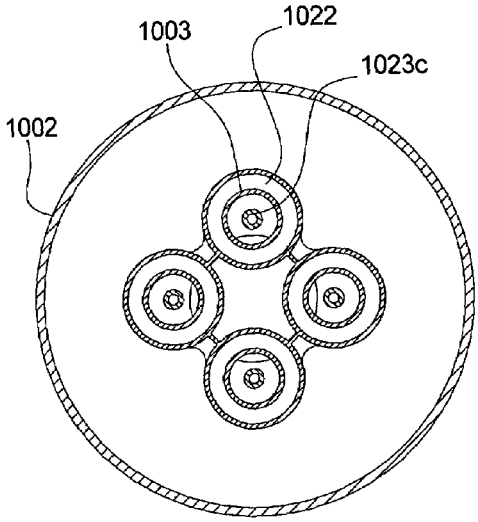
FIG. 14 is a cutaway view of the embodiment of FIGS. 10 and 11, as viewed from reference line 14—14 of FIG. 11.
Figure 15:
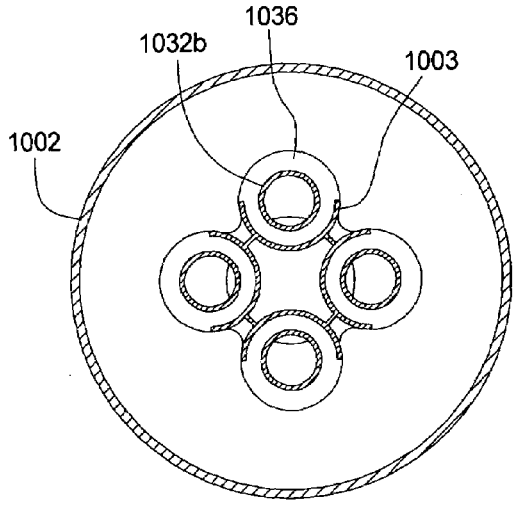
FIG. 15 is a cutaway view of the embodiment of FIGS. 10 and 11, as viewed from reference line 15—15 of FIG. 11.

The air exiting the first stage outlet 2703 passes to a second stage entry port 2729', which divides the airflow into separate parallel fluid flows, preferably in a manner such as described with reference to FIG. 11. Each of the separate flows is conveyed to a corresponding separator comprising an upper tube 2723*a*, co-linear lower tube 2723*b* and vortex controller 2723*c*. These separators remove additional fine debris from the fluid flow and deposit it in a second stage collection chamber 2725' located at the center of the spaced-apart separators. The air exits through the lower tubes 2723*b* and to the suction motor 2718. A pre-motor filter 2724 may be provided to further clean the airflow. The separators of this embodiment may alternatively be arranged in a tight circle and rotated such that they deposit the dirt into a collection chamber located radially outward of the separators, as in FIGS. 10–15.

The various parts of the separation device preferably are assembled as stackable units. In the shown embodiment, the motor 2718 and pre-motor filter 2724 are enclosed in a base housing 2705, upon which the remaining parts rest. The second stage collection chamber 2725' and lower tubes 2723*b* of the separators are formed as a first stack unit 2706, which fits onto the base housing 2705. The upper separator tubes 2723*a* and the central region 2707 of the housing that forms the outer walls of the second stage separation chambers 2722' are formed as a second stack unit 2708, which fits on top of the first stack unit 2705. The upper collection chamber 2725 and separation chamber 2722 are formed together with the first stage outlet 2703 as a third stack unit 2709 that fits on top of the second stack unit 2708. Finally, the upper separation chamber 2722 is enclosed by a cover 2730 that rests at the top of the second stack unit 2709 to complete the assembly. The filter 2702 may be attached to either the cover 2730 or the first stage outlet 2703. using this construction, the various stack units can be easily disassembled to empty the collection chambers 2725, 2725' and clean the various parts of the device.

Another embodiment of a vertically stacked multi-stage separator 2800 is shown in FIG. 28. The first separation stage 2801 of this embodiment is similar to that of FIG. 27, but the second separation stage 2801' is somewhat different. As described before, the first separation stage 2801 comprises a cyclonic separation chamber 2822 having a tangential inlet 2829 and a mesh screen 2802 or filter about which the dirt-laden air flows before eventually passing therethrough to the first stage outlet tube 2803. Dirt separated by the first stage 2801 is deposited in a first stage collection chamber 2825.

The second separation stage 2801' of the embodiment of FIG. 28 comprises a single separator comprising an upper tube 2823*a*, a co-linear hollow lower tube 2823*b*, and a vortex controller 2823*c*, that operate as described in previous embodiments. This embodiment differs from those described previously in that the upper tube 2823*a* is nested within the first stage outlet tube 2803, and the space between the upper tube 2823*a* and the outlet tube 2803 forms the second stage separation chamber 2822', providing a more compact device. The air entering the second separation stage 2801' through the screen 2802 may have sufficient cyclonic movement to provide the desired separation. If it does not (which is likely the case if the screen is replaced by a relatively dense filter), vortex-generating structures may be positioned in the space between the upper tube 2823*a* and the screen 2802 or outlet tube 2803. Helical fins (FIG. 33) or vortex-generating inlet passages (FIGS. 29*a* and 29*b*) are two examples of structures that may be used to initiate cyclonic movement to the air entering the second separation stage 2801'. The second collection chamber 2825' is located immediately below the first collection chamber 2825.

In a preferred embodiment, the first stage separation chamber 2822 and collection chamber 2825 are formed as a single part with the first stage outlet 2803. The screen 2802 and upper tube 2823*a* are mounted to (or formed as part of) a cover 2830, which seals the upper separation/collection chamber 2822, 2825. The second stage collection chamber 2825' is formed integrally with the lower tube 2823*b*. In this embodiment, the device may be readily emptied by simply removing the cover 2830 and associated parts, and removing and inverting first and second stage collection chambers 2825, 2825'.

Air exiting the second separation stage 2801' passes through an optional pre-motor filter 2824 and into the suction motor 2818, which expels the air out of the device 2800. FIG. 28 also shows an optional variation that may be used with the present invention, which is to use the suction motor 2818 as a two-stage pump. In this configuration, the suction motor 2818 drives a first impeller 2808, which receives dirt-laden air through a main inlet 2809 (which is attached to a nozzle or other cleaning head). The impeller 2808 pulls in the air and directs it through a conduit 2810 to the first stage entry port 2829. The suction motor 2818 also has a suction fan 2811 that pulls the air through the conduit 2810 and the separation stages 2801, 2801' and ejects the air from the device 2800, as in the previous embodiments. In such an embodiment, the relative strengths of the impeller 2808 and suction fan 2811 may be adjusted to optimize the airflow characteristics and separation efficiency. In any event, it is preferred that the suction fan 2811 create enough vacuum to keep the conduit 2810 and separation stages 2801, 2801' at a lower pressure than atmospheric pressure, which should prevent the dirt-laden air from tending to escape into the atmosphere through the seams of the vacuum 2800.

Figure 29A:
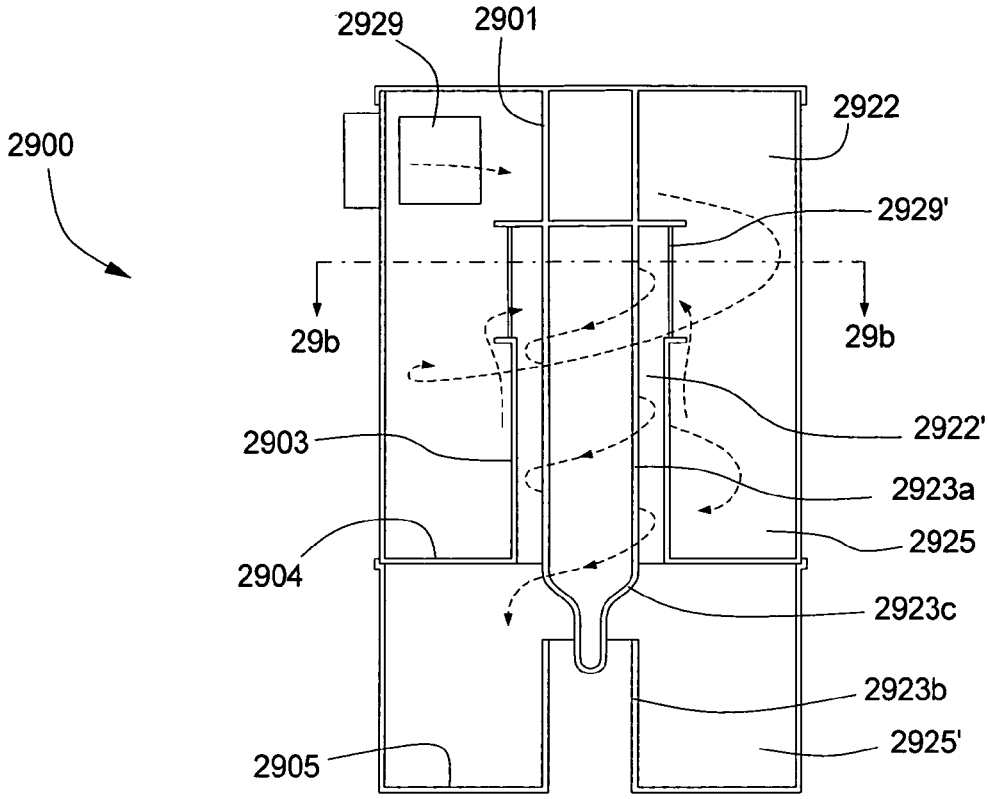
FIG. 29*a* is a cutaway side view of another preferred embodiment of a dust separation system of the invention.
Figure 29B:
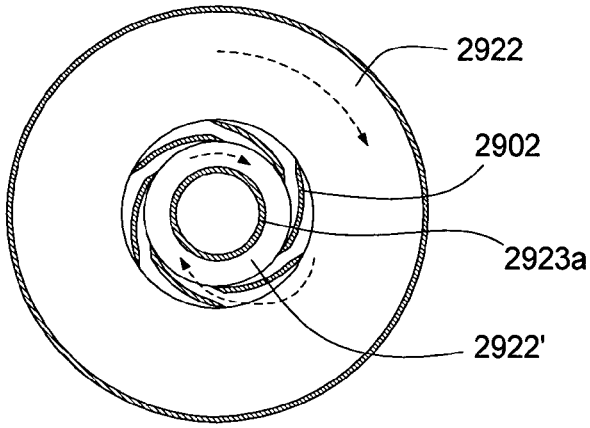
FIG. 29*b* is a cutaway top view of the embodiment of FIG. 29*a*, as viewed from reference line 29*b*—29*b* of FIG. 29*a*.

FIGS. 29*a* and 29*b* depict another preferred embodiment of the invention. In this embodiment, the separation system 2900 comprises a two-stage separator having a first stage entry port 2929 that directs air tangentially into a first stage separation chamber 2922. A cylindrical central obstruction 2901 is placed in the center of the first stage separation chamber 2922 to help promote cyclonic movement and dirt separation. A first stage collection chamber 2925 is provided below the first stage separation chamber 2922.

As with the embodiment of FIG. 28, a second stage separator is provided, at in part, concentrically within the first stage separator. The second stage separator comprises an upper tube 2923*a*, a coaxially aligned hollow lower tube 2923*b*, and a vortex controller 2923*c* extending down from the upper tube 2923*a*. A second stage separation chamber 2922' is formed between the upper tube 2923*a* and an outlet tube 2903 located at the center of the of the first stage collection chamber 2925. Dirt separated by the second stage is deposited into a second stage collection chamber 2925' located below the first stage collection chamber 2925. It will be understood that the second stage collection chamber 2925' may alternatively be located concentrically within the first stage collection chamber 2925, as shown in the embodiment of FIG. 16, by removing the existing lower wall 2904 of the first stage collection chamber 2925 and extending the outlet tube 2903 to the lower wall 2905 of the second stage collection chamber 2925'.

Figure 33:
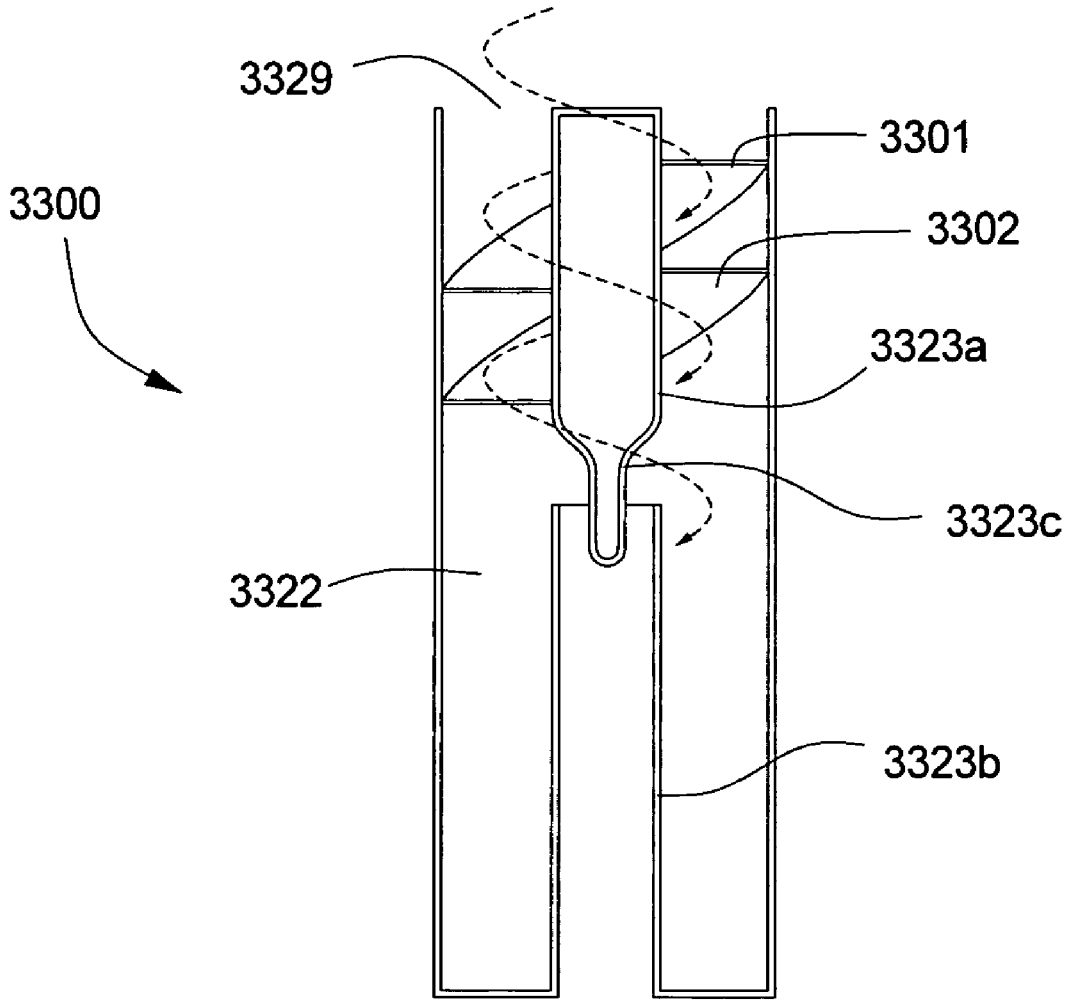
FIG. 33 is a cutaway side view of another preferred embodiment of a dust separation system of the invention.

The second stage separator receives air through an annular entry port 2929', which is located between the first stage entry port 2929 and the first stage collection chamber 2925, but may be located at the same level with the first stage entry port 2829 or above it. As shown in FIG. 29*b*, the annular entry port 2929' comprises one or more inlet vanes 2902 that are shaped to impart a tangential vector to the air passing therethrough. While the vanes 2902 are shown in the figures as being shaped to direct the air into the second stage separation chamber 2922' in the same direction as the air is rotating in the first stage separation chamber 2922, they may be curved such that they reverse the airflow. It is also within the scope of the invention to provide other cyclone-generating shapes to generate a tangential flow in the second stage entry port 2929', such as by incorporating a helical fin, as shown in FIG. 33, or by other means.

Figure 30:
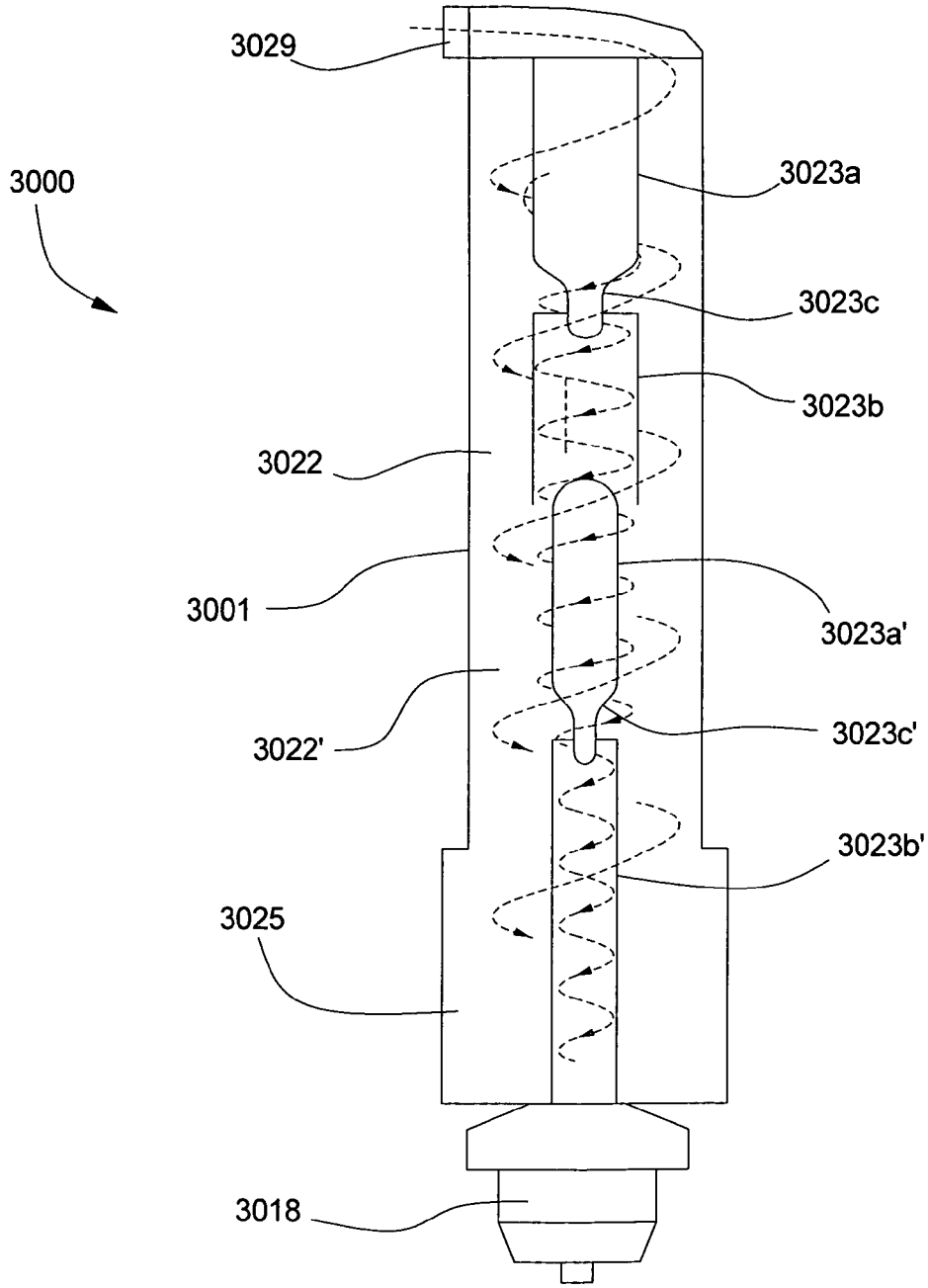
FIG. 30 is a schematic side view of another preferred embodiment of a dust separation system of the invention.

Another embodiment of a multi-stage separator of the present invention is shown in FIG. 30. In this embodiment, the invention comprises a separation system 3000 having two coaxially-aligned separators. The first separator comprises a first upper tube 3023*a*, a first coaxial, hollow lower tube 3023*b*, and a first vortex controller 3023*c*. A first stage separation chamber 3022 is formed around these parts, and they operate as described previously herein. The second separation stage begins at a closed second upper tube 3023*a'* and includes a second lower tube 3023*b* and a second vortex controller 3023*c'*. A second separation chamber 3022' is formed around these parts. In this embodiment, the first lower tube 3023*b* partially surrounds the second upper tube 3023*a*, and the first and second separation chambers 3022, 3022' are continuous with one another. Debris separated by both separation stages is collected in a single collection chamber 3025. This embodiment may also be modified by locating a wall (not shown) between the lower end of the first lower tube 3023*b* and the outer wall 3001 of the device, to thereby provide a separate collection chamber for the first separation stage.

Air is drawn through the device 3000 by a suction motor 3018. The air that enters the first lower tube 3023*b* is allowed to exit the confines of this tube as it enters the second separation stage, thus giving any dirt or debris that is still entrained therein the opportunity to be separated by the second separation stage. The lengths and diameters of the first and second upper and lower tubes 3023*a*, 3023*a*', 3023*b*, 3023*b*' can be adjusted to provide improved overall separation performance. For example, the first upper and lower tubes 3023*a*, 3023*b* may have a diameter that is approximately 1.5 times the diameter of the second upper and lower tubes 3023*a*', 3023*b*'. Other relationships will be readily developed through routine experimentation. When incorporated into a vacuum, the device (or other embodiments of the invention) may also be provided with interchangeable tube sets that the end user can use to optimize cleaning for particular applications.

Figure 31A:
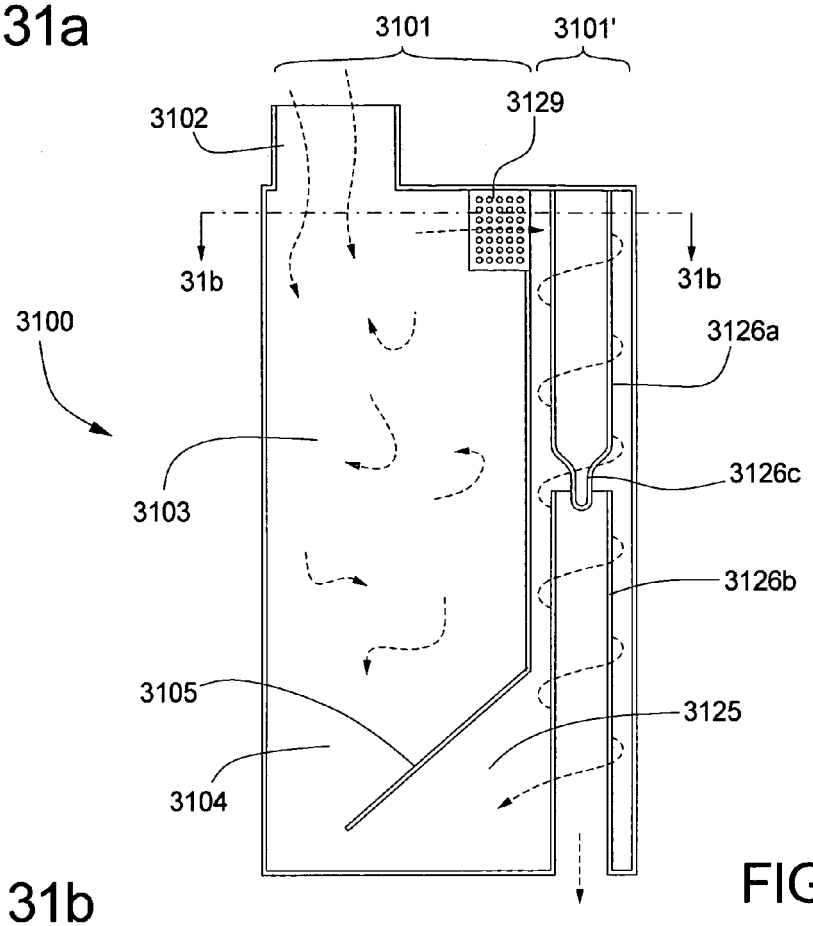
FIG. 31*a* is a cutaway side view of another preferred embodiment of a dust separation system of the invention.
Figure 31B:
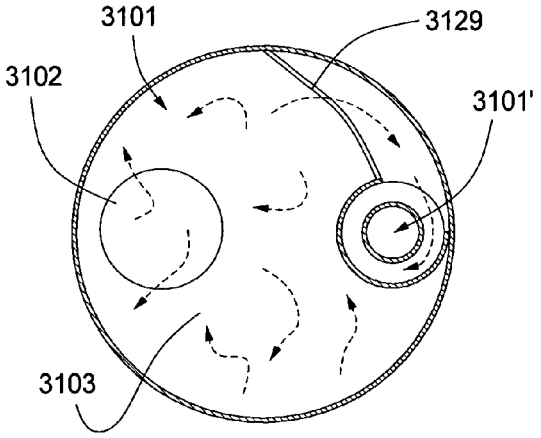
FIG. 31*b* is a cutaway top view of the embodiment of FIG. 31*a*, as viewed from reference line 31*b*—31*b* of FIG. 31*a*.

Still another preferred embodiment of the invention is shown in FIGS. 31*a* and 31*b*. In this embodiment, a cyclonic separation system as described previously herein is shown used in conjunction with a conventional random-flow separation stage. In this embodiment, the first separation stage 3101 comprises a first separation chamber 3103 into which dirt-laden air is introduced by way of a first stage entry port 3102. The entry port 3102 and chamber 3103 are not provided with structures to generate a cyclonic separation effect, and therefore the air flows somewhat randomly through the first separation chamber 3103. Regardless, some amount of separation may occur in the chamber 3103, and dirt that is removed settles in a first stage collection chamber 3104. Air exits the first separation chamber 3103 by entering the second stage entry port 3129, which directs the air tangentially into a second stage separator 3101' comprising an upper tube 3123*a*, lower tube 3123*b* and vortex controller 3123*c*, such as those described elsewhere herein. The second stage entry port 3129 may be an unobstructed open passage, but preferably is covered by a screen, perforated plate (as shown) or a filter.

The second stage separator 3101' deposits removed debris into a second stage collection chamber 3125. The second stage collection chamber 3125 is shown in this embodiment as being open at its bottom and continuous with the first stage collection chamber 3104, but if a significant amount of air bypasses the second stage entry port 3129 through this opening, it may be sealed by extending the boundary wall 3105 between the collection chambers 3104, 3125 down to the bottom of the chamber.

Figure 32:
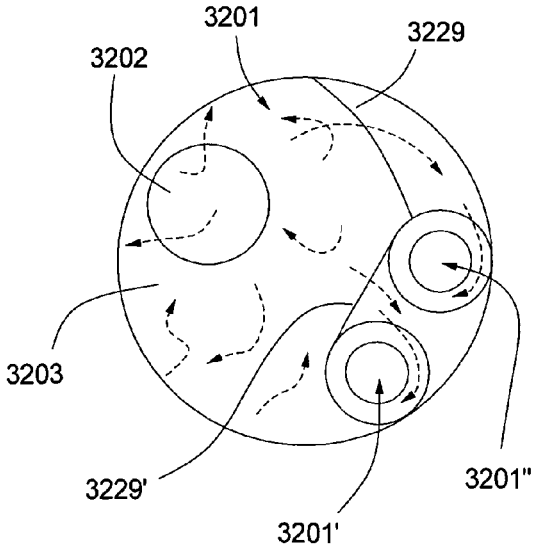
FIG. 32 is a schematic top view of yet another embodiment of a dust separation system of the invention.

FIG. 32 shows a variation on the embodiment of FIGS. 31*a* and 31*b* in which two second stage separators 3201' and 3201" are provided in addition to the non-cyclonic first stage separator 3201. This embodiment is otherwise identical to the embodiment of FIGS. 31*a* and 31*b*. In still another variation of these embodiments (not shown), the first stage separator 3101 may actually be a cyclonic separation stage. This may be accomplished by moving the first stage entry port 3102 to a position where it imparts a tangential component to the air entering the first stage separator 3101, or by providing baffles or other structures to generate cyclonic air flow. It is also anticipated that some cyclonic movement in the first separation chamber 3103 may be created by the suction of the second stage separator 3101', even if the first separation chamber would not normally produce cyclonic flow.

FIG. 33 shows another embodiment of the invention in which the separator 3300 comprises helical fins 3301, 3302 that impart a rotational vector to air entering the entry port 3329. This embodiment may be used in lieu of other vortex-generating entry port shapes for any of the foregoing embodiments of the invention. Helical fins 3301, 3302 may also (or alternatively) be located within the hollow tube 3323*b* of the separator to help maintain cyclonic flow throughout the system.

Referring now to FIGS. 34 through 37, the vortex controller of the present invention is shaped to smooth the airflow as it enters the hollow tube of the separator. To this end, the vortex controller generally begins at the outer diameter of the closed tube, and ends at a diameter (or a point) that fits within the inner diameter of the open outlet tube. FIGS. 34 through 37 show various exemplary shapes for the vortex controller, but other shapes may be used.

Figure 34:
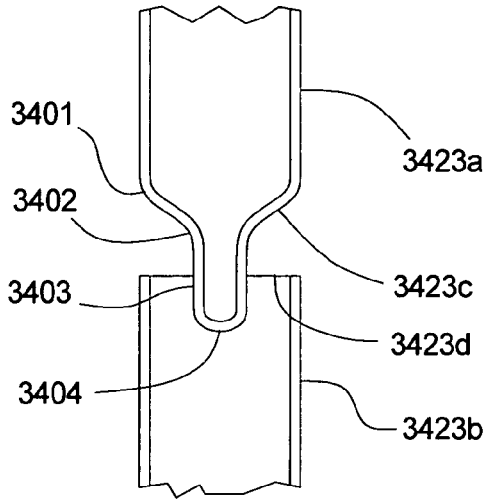
FIG. 34 is a cutaway side view of an embodiment of a vortex controller of the invention.

In a preferred embodiment shown in FIG. 34, the vortex controller 3423*c* has rounded surfaces 3401, 3402 that smoothly reduce the diameter of the upper tube 3423*a* until it forms a cylindrical portion 3403 that fits within the outlet opening 3423*d*. The vortex controller 3423*c* then terminates at a rounded tip 3404. It is believed that the radii and shapes of the curved portions 3401, 3402 and tip 3404, and the length and diameter of the cylindrical portion 3403 can all be experimented with to adjust the separation performance.

Figure 35:
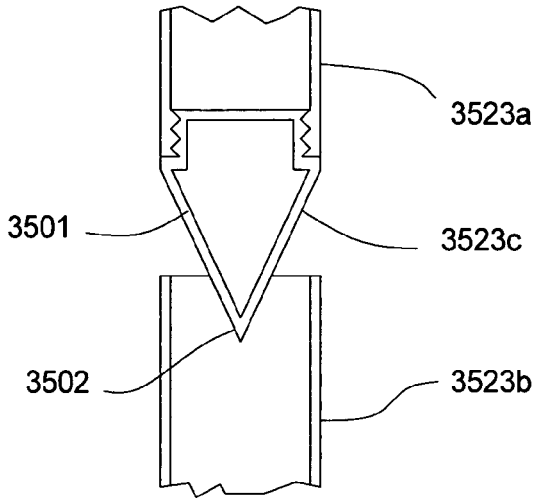
FIG. 35 is a cutaway side view of an embodiment of a vortex controller of the invention.

In another embodiment, shown in FIG. 35, the vortex controller 3523*c* may have a linear profile that forms a conical shape 3501 that terminates at a point 3502, or at a rounded or flat tip. This embodiment also illustrates that the vortex controller 3523*c* of this or other embodiments may be provided as a separate piece that may be removable from the closed tube 3523*a*. In this case, the vortex controller 3523*c* is held in place by a threaded fitting, but other retention methods may be used to permanently or releasable attach the vortex controller 3523*c*. A product incorporating the separator of the present invention may be provided with replaceable vortex controllers having different shapes from which the user can select to optimize cleaning performance.

Figure 36:
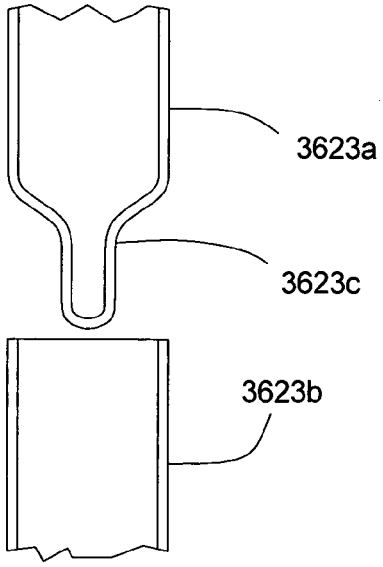
FIG. 36 is a cutaway side view of an embodiment of a vortex controller of the invention.

Still another embodiment of a vortex controller is shown in FIG. 36. In this embodiment, the vortex controller 3623*c* does not actually extend into the hollow tube 3623*b*, but is spaced therefrom. It is believed that the spacing distance (or the overlap distance, if the vortex controller does extend into the hollow tube), may be adjusted to tune the cleaning performance of the device.

Figure 37:
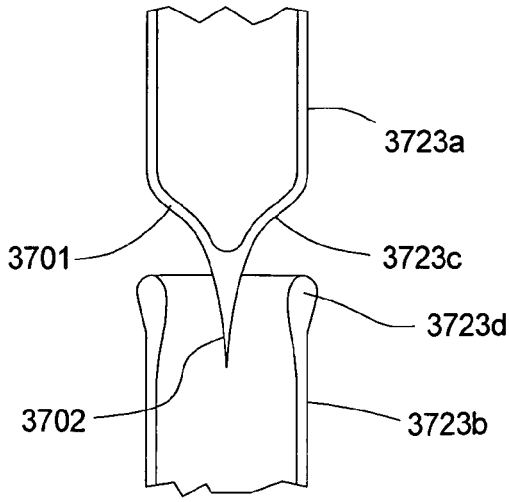
FIG. 37 is a cutaway side view of an embodiment of a vortex controller of the invention.

A final exemplary embodiment of a vortex controller is shown in FIG. 37. In this embodiment, the vortex controller 3723*c* comprises a curved profile 3701 that terminates at a point 3702. This embodiment shows the additional feature of providing the opening edge 3723*d* of the hollow tube 3723*b* with a contoured shape to help improve airflow into the hollow tube 3723*b*.

While the embodiments of FIGS. 34 through 37 show the separator's hollow tube located below the closed tube, it will be understood that these relationships may be inverted or angled, as described elsewhere herein. Furthermore, the various features of each embodiment, such as the contoured opening edge 3723*d* of FIG. 37, the replaceable vortex controller 3523*c* of FIG. 35, and the spaced apart vortex controller 3623*c* and hollow tube 3623*b* of FIG. 36, may be used in any other embodiment of the invention, if desired. It should be understood that the vortex controller is not strictly required in order to produce a functioning separation system. It will also be understood that the closed tube may be solid or hollow. The closed tube may also be open or hollow at the end adjacent the hollow tube, provided it is blocked off at some point to prevent air from flowing therethrough. In such an embodiment, it is believed that the air within the closed tube will remain relatively stagnant, and separation will occur as described herein despite the end of the tube being open.

It will be appreciated that the forgoing embodiments of the invention provide numerous benefits over known cleaning systems. In many of the embodiments, virtually all of the relatively large dirt particles are separated from the airstream by a cyclone generator having coaxially-aligned closed and open tubes, where the open tube serves as the separator air outlet, and a vortex controller is provided to help direct the airflow through the outlet. It is believed that by adjusting the shapes, diameters and lengths of the tubes and the shape of the vortex controller and the separation chamber in which the tubes are located, the device can be adjusted to separate dirt out of the incoming airstream to the point where substantially none of the dirt in the airflow continues to the suction source. The particles that do continue to the suction source (if any) will only comprise the smallest of the particles, and these can be easily filtered out of the airflow using a conventional filter. If few or none of the particles continue to the suction source, then no filter is necessary, but a pre-motor filter may still be provided to avoid damage to the motor in the event of a malfunction or operation when the device if over-filled, and a post-motor filter may be provided to filter out contaminants generated by the motor itself. By separating large debris without using a filter for the main separation stage, embodiments of the invention can avoid clogging and consequent reductions in vacuuming power caused by large particles blocking the filter, and allows the vacuum to be used to pick up large debris that would rapidly deteriorate the performance of conventional vacuums. The vacuum cleaners of the preferred embodiments also improve particle separation efficiency while reducing the pressure drop typically associated with bagless or bagged dust collecting devices. Furthermore, the pressure drop at the surface being vacuumed is expected to remain relatively constant, even as dirt and debris accumulates in the device. Other advantages of the invention will become apparent to those of ordinary skill in the art with practice of the invention and in view of the present disclosure.

While the invention has been described in connection with several preferred embodiments, one of ordinary skill in the art will recognize that the principles of operation of the dust separation system may be readily adapted to many different vacuum cleaning environments and configurations. Furthermore, while various principles of operation have been described herein, the present invention is not intended to be limited to operating by the disclosed principles.

The invention claimed is:

1. An upright vacuum cleaner comprising:

a nozzle adapted to be traversed on a surface to be cleaned, the nozzle having an internal passage defined by a nozzle inlet positioned to be substantially adjacent the surface to be cleaned and a nozzle outlet remote from the nozzle inlet;

a handle pivotally attached to the nozzle;

a suction motor, mounted in the nozzle or the handle, and having a suction motor inlet, the suction motor being adapted to generate a working air flow through the nozzle and into the suction motor inlet;

a separation system comprising:

an outer wall;

a closed tube having at least a portion of its length located within the outer wall and forming a separation chamber between the outer wall and the closed tube;

a separation chamber inlet in fluid communication with the nozzle outlet and adapted to impart a tangential component to the working air flow as it flows through the separation chamber;

a hollow tube, generally coaxially aligned with the closed tube, having a tube inlet at an end adjacent the closed tube and a tube outlet at an end opposite the closed tube, the tube outlet being in fluid communication with the suction motor inlet;

a collection chamber for receiving dirt separated from the working air flow; and a vortex controller located at and closing an end of the closed tube immediately adjacent the hollow tube.

2. The upright vacuum cleaner of claim 1, wherein the separation system further comprises a vortex controller located at an end of the closed tube adjacent the hollow tube.

3. The upright vacuum cleaner of claim 2, wherein the vortex controller has a first diameter at a point adjacent the closed tube that is substantially the same as an outer diameter of the dosed tube, and a second diameter at a point remote from the end of the closed tube that is less than the first diameter.

4. The upright vacuum cleaner of claim 2, wherein at least a portion of the vortex controller is conical.

5. The upright vacuum cleaner of claim 1, wherein the separation system is oriented with the closed tube and the hollow tube oriented vertically.

6. The upright vacuum cleaner of claim 5, wherein the closed tube is above the hollow tube.

7. The upright vacuum cleaner of claim 5, wherein the closed tube is below the hollow tube.

8. The upright vacuum cleaner of claim 1, wherein the outer wall comprises a cylindrical chamber formed, at least in part, by the collection chamber.

9. The upright vacuum cleaner of claim 8, wherein the collection chamber is integrally formed with the outer wall and the collection chamber and outer wall are selectively removable from the upright vacuum cleaner together.

10. The upright vacuum cleaner of claim 8, wherein the collection, chamber is separately formed from the outer wall and selectively removable from the upright vacuum cleaner separately from the outer wall.

11. The upright vacuum cleaner of claim 1, wherein the outer wail comprises a cylindrical chamber and the closed tube and hollow tube are coaxially aligned with the centerline of the cylindrical chamber.

12. The upright vacuum cleaner of claim 1, wherein the separation chamber inlet is in fluid communication with the nozzle outlet at least partially by way of a flexible hose.

13. The upright vacuum cleaner of claim 12, wherein the flexible hose is removable from the nozzle outlet and useable as an accessory cleaning tool.

14. The upright vacuum cleaner of claim 1, wherein the separation chamber inlet is in fluid communication with the nozzle outlet at least partially by way of a rigid conduit located in the handle.

15. The upright vacuum cleaner of claim 1, wherein the separation chamber inlet is in fluid communication with the nozzle outlet at least partially by way of a rigid conduit integrally formed with the outer wall.

16. A vacuum cleaner comprising:

a nozzle adapted to be traversed on a surface to be cleaned, the nozzle having an internal passage defined by a nozzle inlet positioned to be substantially adjacent the surface to be cleaned and a nozzle outlet remote from the nozzle inlet;

a main vacuum housing attached to the nozzle by way of a flexible hose;

a suction motor, mounted in the main vacuum housing, and having a suction motor inlet, the suction motor being adapted to generate a working air flow through the nozzle and into the suction motor inlet;

a separation system comprising:

an outer wall;

a closed tube having at least a portion of its length located within the outer wall and forming a separation chamber between the outer wall and the closed tube;

a separation chamber inlet in fluid communication with the nozzle outlet and adapted to impart a tangential component to the working air flow as it flows through the separation chamber;

a hollow tube, generally coaxially aligned with the closed tube, having a tube inlet at an end adjacent the dosed tube and a tube outlet at an end opposite the dosed tube, the tube outlet being in fluid communication with the suction motor inlet;

a collection chamber for receiving dirt separated from the working air flow; and a vortex controller located at and closing an end of the closed tube immediately adjacent the hollow tube.

17. The vacuum cleaner of claim 16, wherein the separation system further comprises a vortex controller located at an end of the closed tube adjacent the hollow tube.

18. The vacuum cleaner of claim 17, wherein the vortex controller has a first diameter at a point adjacent the closed tube that is substantially the same as an outer diameter of the closed tube, and a second diameter at a point remote from the end of the closed tube that is less than the first diameter.

19. The vacuum cleaner of claim 17, wherein at least a portion of the vortex controller is conical.

20. The vacuum cleaner of claim 16, wherein the separation system is oriented with the closed tube and the hollow tube oriented horizontally.

21. The vacuum cleaner of claim 16, wherein the separation chamber inlet is located adjacent an end of the closed tube that is opposite the hollow tube.

22. The vacuum cleaner of claim 16, wherein the separation chamber inlet is located adjacent an end of the hollow tube that is opposite the dosed tube.

23. The vacuum cleaner of claim 16, wherein the outer wall comprises a cylindrical chamber and the dosed tube and hollow tube are coaxially aligned with the centerline of the cylindrical chamber.

24. A vacuum cleaner comprising:

a nozzle adapted to be traversed on a surface to be cleaned, the nozzle having an internal passage defined by a nozzle inlet positioned to be substantially adjacent the surface to be cleaned and a nozzle outlet remote from the nozzle inlet;

a suction motor, mounted to the vacuum cleaner, and having a suction motor inlet, the suction motor being adapted to generate a working air flow through the nozzle and into the suction motor inlet;

a separation system; located, in a fluid flow sense, between the nozzle outlet and the suction motor inlet, and comprising a first separator and a second separator, each of the first separator and the second separator being adapted to remove dirt from the working air flow;

and at least one collection chamber adapted to receive dirt separated from the working air flow;

wherein the first separator comprises at least one co-linear tube separator comprising:

an outer wall;

a closed tube having at least a portion of its length located within the outer wall and forming a separation chamber between the outer wall and the closed tube;

a separation chamber inlet in fluid communication with the nozzle outlet and adapted to impart a tangential component to the working air flow as it flows through the separation chamber;

a hollow tube, generally coaxially aligned with the dosed tube, having a tube inlet at an end adjacent the closed tube and a tube outlet at an end opposite the closed tube, the tube outlet being in fluid communication with the suction motor; and a vortex controller located at and closing an end of the closed tube immediately adjacent the hollow tube.

25. The vacuum cleaner of claim 24, wherein the co-linear tube separator further comprises a vortex controller located at an end of the closed tube adjacent the hollow tube.

26. The vacuum cleaner of claim 24, wherein the outer wall comprises a cylindrical chamber and the closed tube and hollow tube are coaxially aligned with the centerline of the cylindrical chamber.

27. The vacuum cleaner of claim 24, wherein the second separator comprises a conventional cyclone separator comprising:

a cyclone chamber;

a cyclone inlet in fluid communication with the working air flow and adapted to introduce a tangential component to the working air flow as it flows within the cyclone chamber;

and a cyclone outlet.

28. The vacuum cleaner of claim 27, wherein at least a portion of the first separator is arranged concentrically within the second separator, and the working air flow is adapted to enter the first separator after it exits the second separator.

29. The vacuum cleaner of claim 27, wherein the first separator is arranged adjacent the second separator, and the working air flow is adapted to enter the first separator after it exits the second separator.

30. The vacuum cleaner of claim 24, wherein the working air flow is adapted to enter the first separator after it exits the second separator.

31. The vacuum cleaner of claim 24, wherein the working air flow is adapted to enter the second separator after it exits the first separator.

32. The vacuum cleaner of claim 24, wherein the second separator is not a cyclonic separator.

33. An upright vacuum cleaner comprising:

a nozzle adapted to be traversed on a surface to be cleaned, the nozzle having an internal passage defined by a nozzle inlet positioned to be substantially adjacent the surface to be cleaned and a nozzle outlet remote from the nozzle in let;

a handle pivotally attached to the nozzle;

a suction motor, mounted in the nozzle or the handle, and having a suction motor inlet, the suction motor being adapted to generate a working air flow through the nozzle and into the suction motor inlet;

a separation system comprising:

an outer wall;

a dosed tube having at least a portion of its length located within the outer wall and forming a separation chamber between the outer wall and the closed tube;

a separation chamber inlet in fluid communication with the nozzle outlet and adapted to impart a tangential component to the working air flow as it flows through the separation chamber;

a hollow tube, generally coaxially aligned with the closed tube, having a tube inlet at an end adjacent the closed tube and a tube outlet at an end opposite the closed tube, the tube outlet being in fluid communication with the suction motor inlet; and a collection chamber for receiving dirt separated from the working air flow;

wherein the separation system further comprises a vortex controller located at an end of the closed tube adjacent the hollow tube, and at least a portion of the vortex controller has a curved profile.

34. An upright vacuum cleaner comprising:

a nozzle adapted to be traversed on a surface to he cleaned, the nozzle having an internal passage defined by a nozzle inlet positioned to be substantially adjacent the surface to be cleaned and a nozzle outlet remote from the nozzle inlet;

a handle pivotally attached to the nozzle;

a suction motor, mounted in the nozzle or the handle, and having a suction motor inlet, the suction motor being adapted to generate a working air flow through the nozzle and into the suction motor inlet;

a separation system comprising:

an outer wall;

a dosed tube having at least a portion of its length located within the outer wall and forming a separation chamber between the outer wall and the closed tube;

a separation chamber inlet in fluid communication with the nozzle outlet and adapted to impart a tangential component to the working air flaw as it flows through the separation chamber;

a hollow tube, generally coaxially aligned with the closed tube, having a tube inlet at an end adjacent the closed tube and a tube outlet at an end opposite the closed tube, the tube outlet being in fluid communication with the suction motor inlet; and a collection chamber for receiving dirt separated from the working air flow;

wherein the separation system further comprises a vortex controller located at an end of the closed tube adjacent the hollow tube, and the vortex controller extends into the tube inlet.

35. An upright vacuum cleaner comprising:

a nozzle adapted to be traversed on a surface to be cleaned, the nozzle having an internal passage defined by a nozzle inlet positioned to be substantially adjacent the surface to be cleaned and a nozzle outlet remote from the nozzle inlet;

a handle pivotally attached to the nozzle;

a suction motor, mounted in the nozzle or the handle, and having a suction motor inlet, the suction motor being adapted to generate a working air flow through the nozzle and into the suction motor inlet;

a separation system comprising:

an outer wall;

a closed tube having at least a portion of its length located within the outer wall and forming a separation chamber between the outer wall and the closed tube;

a separation chamber inlet in fluid communication with the nozzle outlet and adapted to impart a tangential component to the working air flow as it flows through the separation chamber;

a hollow tube, generally coaxially aligned wit the closed tube, having a tube inlet at an end adjacent the closed tube and a tube outlet at an end opposite the closed tube, the tube outlet being in fluid communication with the suction motor inlet; and a collection chamber for receiving dirt separated from the working air flow, the collection chamber being offset from the center axes of the closed tube and the hollow tube.

36. The upright vacuum cleaner of claim 35, wherein the collection chamber is fluidly connected to the separation chamber by an opening through the side of the outer wall.

37. The upright vacuum cleaner of claim 36, wherein the collection chamber is selectively removable from the upright vacuum cleaner separately from the outer wall.

38. A vacuum cleaner comprising:

a nozzle adapted to be traversed on a surface to be cleaned, the nozzle having an internal passage defined by a nozzle inlet positioned to be substantially adjacent the surface to be cleaned and a nozzle outlet remote from the nozzle inlet;

a main vacuum housing attached to the nozzle by way of a flexible hose;

a suction motor, mounted in the main vacuum housing, and having a suction motor inlet, the suction motor being adapted to generate a working air flow through the nozzle and into the suction motor inlet;

a separation system comprising:

an outer wall;

a closed tube having at least a portion of its length located within the outer wall and forming a separation chamber between the outer wall and the closed tube;

a separation chamber inlet in fluid communication with the nozzle outlet and adapted to impart a tangential component to the working air flow as it flows through the separation chamber;

a hollow tube, generally coaxially aligned with the dosed tube, having a tube inlet at an end adjacent the closed tube and a tube outlet at an end opposite the closed tube, the tube outlet being in fluid communication with the suction motor inlet; and a collection chamber for receiving dirt separated from the working air flow;

wherein the separation system further comprises a vortex controller located at an end of the closed tube adjacent the hollow tube, and at least a portion of the vortex controller has a curved profile.

39. A vacuum cleaner comprising:

a nozzle adapted to be traversed on a surface to be cleaned, the nozzle having an internal passage defined by a nozzle inlet positioned to be substantially adjacent the surface to be cleaned and a nozzle outlet remote from the nozzle inlet;

a main vacuum housing attached to the nozzle by way of a flexible hose;

a suction motor, mounted in the main vacuum housing, and having a suction motor inlet, the suction motor being adapted to generate a working air flow through the nozzle and into the suction motor inlet;

a separation system comprising:

an outer wall;

a closed tube having at least a portion of its length located within the outer wall and forming a separation chamber between the outer wall and the closed tube;

a separation chamber inlet in fluid communication with the nozzle outlet and adapted to impart a tangential component to the working air flow as it flows through the separation chamber;

a hollow tube, generally coaxially aligned with the closed tube, having a tube inlet at an end adjacent the closed tube and a tube outlet at an end opposite the closed tube, the tube outlet being in fluid communication with the suction motor inlet; and a collection chamber for receiving dirt separated from the working air flow;

wherein the separation system further comprises a vortex controller located at an end of the closed tube adjacent the hollow tube, and the vortex controller extends into the tube inlet.

40. A vacuum cleaner comprising:

a nozzle adapted to be traversed on a surface to be cleaned, the nozzle having an internal passage defined by a nozzle inlet positioned to be substantially adjacent the surface to be cleaned and a nozzle outlet remote from the nozzle inlet;

a main vacuum housing attached to the nozzle by way of a flexible hose;

a suction motor, mounted in the main vacuum housing, and having a suction motor inlet, the suction motor being adapted to generate a working air flow through the nozzle and into the suction motor inlet;

a separation system comprising:

an outer wall;

a closed tube having at least a portion of its length located within the outer wall and forming a separation chamber between the outer wall and the dosed tube;

a separation chamber inlet in fluid communication with the nozzle outlet and adapted to impart a tangential component to the working air flow as it flows through the separation chamber;

a hollow tube, generally coaxially aligned with the closed tube, having a tube inlet at an end adjacent the closed tube and a tube outlet at an end opposite the closed tube, the tube outlet being in fluid communication with the suction motor inlet; and a collection chamber for receiving dirt separated from the working air flow, the collection chamber being offset from the center axes of the closed tube and the hollow tube.

41. The vacuum cleaner of claim 40, wherein the collection chamber is fluidly connected to the separation chamber by an opening through the side of the outer wall.

42. The vacuum cleaner of claim 41, wherein the collection chamber is selectively removable from the upright vacuum cleaner separately from the outer wall.

43. A vacuum cleaner comprising:

a nozzle adapted to be traversed on a surface to be cleaned, the nozzle having an internal passage defined by a nozzle inlet positioned to be substantially adjacent the surface to be cleaned and a nozzle outlet remote from the nozzle inlet;

a suction motor, mounted to the vacuum cleaner, and having a suction motor inlet, the suction motor being adapted to generate a working air flow through the nozzle and into the suction motor inlet;

a separation system; located, in a fluid flow sense, between the nozzle outlet and the suction motor inlet, and comprising a first separator and a second separator, each of the first separator and the second separator being adapted to remove dirt from the working air flow;

and at least one collection chamber adapted to receive dirt separated from the working air flow;

wherein the first separator comprises at least one co-linear tube separator comprising:

an outer wall;

a closed tube having at least a portion of its length located within the outer wall and forming a separation chamber between the outer wail and the closed tube;

a separation chamber inlet in fluid communication with the nozzle outlet and adapted to impart a tangential component to the working air flow as it flows through the separation chamber;

a hollow tube, generally coaxially aligned with the closed tube, having a tube inlet at an end adjacent the closed tube and a tube outlet at an end opposite the closed tube, the tube outlet being in fluid communication with the suction motor inlet;

wherein the second separator comprises a conventional cyclone separator comprising:

a cyclone chamber;

a cyclone inlet in fluid communication with the working air flow and adapted to introduce a tangential component to the working air flow as it flows within the cyclone chamber; and a cyclone outlet located in the bottom of the cyclone chamber.

44. The vacuum cleaner of claim 43, wherein the first separator is arranged below the second separator, and the working air flow is adapted to enter the first separator after it exits the second separator.

45. A vacuum cleaner comprising:

a nozzle adapted to be traversed on a surface to be cleaned, the nozzle having an internal passage defined by a nozzle inlet positioned to be substantially adjacent the surface to be cleaned and a nozzle outlet remote from the nozzle inlet;

a suction motor, mounted to the vacuum cleaner, and having a suction motor inlet, the suction motor being adapted to generate a working air flow through the nozzle and into the suction motor inlet;

a separation system; located, in a fluid flow sense, between the nozzle outlet and the suction motor inlet, and comprising a first separator and a second separator, each of the first separator and the second separator being adapted to remove dirt from the working air flow;

and at least one collection chamber adapted to receive dirt separated from the working air flow;

wherein the first separator comprises a plurality of co-linear tube separators, each of the co-linear tube separators comprising:

an outer wall;

a closed tube having at least a portion of its length located within the outer wall and forming a separation chamber between the outer wall and the closed tube;

a separation chamber inlet in fluid communication with the nozzle outlet and adapted to impart a tangential component to the working air flow as it flows trough the separation chamber; and a hollow tube, generally coaxially aligned with the closed tube, having a tube inlet at an end adjacent the closed tube and a tube outlet at an end opposite the closed tube, the tube outlet being in fluid communication with the suction motor inlet.

46. A vacuum cleaner comprising:

a nozzle adapted to be traversed on a surface to be cleaned, the nozzle having an internal passage defined by a nozzle inlet positioned to be substantially adjacent the surface to be cleaned and a nozzle outlet remote from the nozzle inlet;

a suction motor, mounted to the vacuum cleaner, and having a suction motor inlet, the suction motor being adapted to generate a working air flow through the nozzle and into the suction motor inlet;

a separation system; located, in a fluid flow sense, between the nozzle outlet and the suction motor inlet and comprising a first separator and a second separator, each of the first separator and the second separator being adapted to remove dirt from the working air flow;

and at least one collection chamber adapted to receive dirt separated from the working air flow;

wherein the first separator comprises at least one co-linear tube separator comprising:

an outer wall;

a closed tube having at least a portion of its length located within the outer wall and forming a separation chamber between the outer waif and the closed tube;

a separation chamber inlet in fluid communication with the nozzle outlet and adapted to impart a tangential component to the working air flow as it flows through the separation chamber;

a hollow tube, generally coaxially aligned with the closed tube, having a tube inlet at an end adjacent the closed tube and a tube outlet at an end opposite the closed tube, the tube outlet being in fluid communication with the suction motor inlet; and wherein the working air flow is divided into a first portion that passes through the first separator, and a second portion that passes through the second separator.

* * * * *